US007650924B1

(12) United States Patent
Bouldin

(10) Patent No.: US 7,650,924 B1
(45) Date of Patent: Jan. 26, 2010

(54) ADJUSTABLE-WIDTH/HEIGHT WINDOW TREATMENT OVERLAY

(76) Inventor: Susan Smith Bouldin, 2908 Ramsgate Ct., Winston-Salem, NC (US) 27106

( * ) Notice: Subject to any disclaimer, the term of this patent is extended or adjusted under 35 U.S.C. 154(b) by 0 days.

(21) Appl. No.: 12/012,438

(22) Filed: Jan. 31, 2008

Related U.S. Application Data

(60) Provisional application No. 60/898,625, filed on Feb. 1, 2007.

(51) Int. Cl.
*A47H 1/00* (2006.01)
*A47H 13/14* (2006.01)
*A47H 13/00* (2006.01)

(52) U.S. Cl. ..... 160/330; 160/348; 160/368.1

(58) Field of Classification Search ..... 160/330, 160/348, 368.1; 428/100, 176, 181, 192; 223/28, 29, 30, 31, 32, 33, 34, 35, 36
See application file for complete search history.

(56) References Cited

U.S. PATENT DOCUMENTS 1,778,449 A 10/1930 King
2,352,531 A 6/1944 Gallo
2,547,697 A 4/1951 Gallo
2,587,492 A 2/1952 Lipetz
2,609,043 A 9/1952 Dubinsky
2,666,481 A 1/1954 White
2,840,155 A * 6/1958 Stern ..... 160/124
3,185,197 A * 5/1965 Spiro et al. ..... 150/154
3,321,004 A * 5/1967 Lopes, Jr. ..... 160/330
3,733,227 A * 5/1973 Collins, Jr. ..... 156/196
3,996,987 A * 12/1976 Rodriguez ..... 160/19
4,420,027 A * 12/1983 Gidge et al. ..... 160/328
4,550,760 A * 11/1985 Gidge et al. ..... 160/328
4,782,873 A * 11/1988 Messner et al. ..... 150/154
4,865,105 A 9/1989 Peters
4,954,384 A * 9/1990 Hartwell ..... 428/100
4,960,161 A * 10/1990 Easley ..... 160/126
5,067,542 A * 11/1991 Easley ..... 160/126
5,074,348 A * 12/1991 Phillips ..... 160/38
5,084,321 A * 1/1992 Sui ..... 428/80
5,094,006 A * 3/1992 Varney ..... 33/563
5,137,190 A * 8/1992 Plaud ..... 223/33
5,191,922 A * 3/1993 Wade ..... 160/124
5,230,375 A 7/1993 Linder
5,255,727 A * 10/1993 Saruwatari et al. ..... 150/154
5,259,520 A 11/1993 Roggio et al.
5,495,628 A * 3/1996 Logan ..... 4/558
5,598,880 A 2/1997 Cross
5,651,407 A * 7/1997 Perez ..... 160/330
5,673,741 A 10/1997 Cairns
5,731,056 A * 3/1998 Butler, III ..... 428/100
5,738,159 A * 4/1998 O'Brien ..... 160/84.01

(Continued)

*Primary Examiner*—Katherine W Mitchell
*Assistant Examiner*—Jaime F Cardenas-Garcia
(74) *Attorney, Agent, or Firm*—Robert W. Pitts

(57) ABSTRACT

A mass marketable decorative window treatment system employs adjustable-width valance pieces or overlays that can be hung from a conventional curtain rod on which a rod sleeve has been mounted. Segmented hook and loop fastener means are employed on both the valance pieces and on a curtain rod subassembly so that the decorative window treatment components need not be permanently secured to a board as required with similar custom window treatments. The width of individual valance pieces, such as, but not limited to, swags and jabots and flat overlays can be adjusted so that the standard size components can be used for different size windows.

20 Claims, 27 Drawing Sheets

U.S. PATENT DOCUMENTS 5,881,471 A * 3/1999 Kaluza ..... 33/563
5,894,642 A 4/1999 Eberhardt
5,894,876 A * 4/1999 O'Brien ..... 160/84.01
6,041,454 A * 3/2000 Summerford ..... 4/558
6,108,918 A * 8/2000 Ye ..... 33/12
6,173,753 B1 1/2001 Laster-Bivens et al.
6,192,962 B1 2/2001 Glover
6,209,614 B1 * 4/2001 Smoot ..... 160/237
6,371,190 B1 * 4/2002 Owens ..... 160/135
6,732,783 B2 * 5/2004 Bouldin ..... 160/348
6,832,642 B2 * 12/2004 Titus et al. ..... 160/330
D505,039 S * 5/2005 Smith et al. ..... D6/575
D507,918 S * 8/2005 Smith et al. ..... D6/575
D509,090 S * 9/2005 Smith et al. ..... D6/575
7,160,600 B2 * 1/2007 Shepard et al. ..... 428/99
2003/0116287 A1 * 6/2003 Titus et al. ..... 160/348
2004/0069415 A1 4/2004 Paraonage
2004/0144505 A1 * 7/2004 Johnson et al. ..... 160/348
2005/0241782 A1 * 11/2005 Nien ..... 160/330
2006/0060314 A1 * 3/2006 Battista ..... 160/330
2006/0081344 A1 * 4/2006 McKearney ..... 160/368.1
2006/0289130 A1 * 12/2006 Zimmer ..... 160/330
2007/0215296 A1 * 9/2007 Voutour ..... 160/330
2007/0261803 A1 * 11/2007 Alexander et al. ..... 160/341
2008/0173413 A1 * 7/2008 Lam et al. ..... 160/348

* cited by examiner

PRIOR
ART

PRIOR
ART

PRIOR ART

ADJUSTABLE-WIDTH/HEIGHT WINDOW TREATMENT OVERLAY

CROSS REFERENCE TO PRIOR CO-PENDING APPLICATION

This application claims the benefit of U.S. Provisional Patent Application Ser. No. 60/898,625 filed Feb. 1, 2007 entitled Adjustable-Width Valance System.

BACKGROUND OF THE INVENTION

1. Field of the Invention

This invention relates to decorative window treatments, such as valances, that can be supported from conventional curtain rods and which can be adjusted for use in different applications. This invention also relates to the use of fastening means, such as hook and loop fasteners, for mounting window treatments or valances.

2. Description of the Prior Art

Custom-made, decorative, board-mounted window treatments, commonly called valances, tend to be relatively high in cost and, therefore, are confined to a relatively small market. These decorative window treatments are typically fabricated by a skilled seamstress or a drapery workroom at the request of an interior decorator. The individual fabric decorative window treatment is sized to fit a specific order, and it is typically nailed to a board that is semi-permanently attached above a window. Unlike common draperies, these decorative window treatment items are not mounted to conventional or standard curtain rods. However, the aesthetic characteristics of these decorative window treatments would make them highly desirable if they could be mass marketed and if they could be adjusted and mounted on a conventional curtain rod by a homeowner, without the need for expertise or more than ordinary skill. Mass marketable or mass produced items of this type are not readily available and are not believed to have been previously sold or marketed. Although attempts to provide an acceptable product, having at least some of these features, have been made, it is believed that these earlier attempts have not been successful efforts to combine sufficient features to satisfactorily meet the requirements of a sufficiently large number of homeowners. A number of related efforts have been discussed in the following patents.

U.S. Pat. No. 5,074,348 discloses decorative swags that can be hung from a board that is in turn mounted on a wall in a permanent manner. A hook or loop attachment strip is mounted on the top of the board, and a mating loop or hook fastener on the swag is attached to the complementary board-mounted attachment strip. Hook and loop fasteners are mounted on opposite sides of the swags for attachment to the board-mounted attachment strip. Other elements, such as jabots, also including hook and loop fasteners, can be placed either on top of or underneath adjacent swags. An alternate embodiment of continuously joined-together swags arranged around a pole is also shown. Hook and loop fasteners can be attached at opposite ends of these swag segments to connect the segments end to end to form a continuous member that can be wrapped or draped around a pole. A fastening tape can also be mounted on the pole and the swags can be detachably fastened end to end to the pole. Significantly, different swag configurations are used for attachment to a board and for attachment to a pole. A conventional telescoping curtain rod appears not to be discussed with reference to either configuration.

U.S. Pat. No. 5,094,006 discloses a template for making a swag that purportedly can be hung by an ordinary householder who does not possess specialized skill or training. The swag can be hung from a touch and close fastener means, or alternative fasteners, located on the rear of a board. Each swag is cut from a template, and apparently the template must be adjusted in order to cut a separate swag having a different width. A single swag cannot therefore be adjusted to a different width. A curtain rod assembly for mounting one of these swags is shown in U.S. Pat. No. 5,673,741 to the top of the telescoping rod assembly where complementary hook and loop fasteners have been attached to both the swag and the curtain rod. U.S. Pat. No. 3,996,987 discloses a valance cover that can be attached to the inner side of an assembly comprising three flat, rigid, oblong members joined to one another or extending as a continuous piece at right angles to one another.

U.S. Pat. No. 5,067,542 discloses a supposedly ready-made swag and pleated jabot system. The swag comprises a curved, folded hanging piece secured to an elongated sleeve piece by a line of stitching. The sleeve piece extends beyond the ends of the hanging piece and an elongated open-ended pocket is formed between opposite ends of the swag. The swag and a similarly pocketed jabot can be hung in conventional fashion from conventional telescoping curtain rods. When the two are used together, the jabot is hung from a front rod and the swag is hung from a separate rear rod.

U.S. Pat. No. 6,192,962 discloses an adjustable telescoping support bar from which multiple window treatments can be hung from the same support bar. The support bar includes hook and loop type fastening means attached to all sides of the support bar for attaching the window treatments to the support bar.

Although these prior patents do show various means for attaching window treatments, such as valances including swags, cascades, jabots etc., from a support member, they do not disclose a system including an adjustable-width window treatment member that can be mounted on a conventional telescoping curtain rod using hook and loop fastening means. Furthermore they do not disclose the use of a separate rod sleeve that can be mounted on a conventional curtain rod. Therefore these prior patents do not show a system in which standard components, suitable for mass production, can be used to decorate windows or other structures. However, the Adjustable-Width Window Treatment System of U.S. Pat. No. 6,732,783 consisting of a Valance Support Device/Variant and accompanying valance components (such as swags, jabots, cascades, horns, pennants) which are constructed to be mounted on the Support Device/Variant does begin to address these issues. The Valance Support Device is a simple apparatus for displaying decorative overlaying valance sections, all of which allow the home shopper to form top window treatments, (i.e., valances) according to his tastes and the size of his particular window(s). The apparatus is either a telescoping rod (in various size ranges) with hook and loop type fastener on its back (i.e., the side which faces the wall or window) or a rod sleeve with hook and loop fastener on one or both sides which sleeve then slips over and entirely covers the common curtain rod or pole (which, again, are offered in many size ranges.) The Adjustable-Width Valance Support Device or Variant is used to display valance components which have the mating hook/loop fastener attached so they may be applied to the rod/rod sleeve or onto each other to form the valance.

One of the most popular of these valance components is known as a swag. Prior art swags are typically made to be of specific dimensions with little to no on-site adjustment possible. An adjustable-width swag of U.S. Pat. No. 6,732,783 is especially constructed in order to allow a variation of at least six inches in its own width. Then each swag so constructed can be adjusted on site to give a custom fit without having to be custom made. This is the only component in this system which has adjustable width features and there are many other popular types of valance components which could be standardized and mass produced for onsite fittings if there were more adjustable width features developed.

SUMMARY OF THE INVENTION

An Adjustable-Width Overlay is a flat valance component which has built in features of hook and loop fastener which will allow the piece to (1) be mounted on a support device such as one of U.S. Pat. No. 6,732,783, (2) be reduced from 2 to 20 plus inches in width, (3) change from a flat front to one with pleats, and (4) have an adjustment in height within the body of the piece, giving the entire treatment an apex/apexes. These choices give the customer the ability to fit his particular window perfectly, and a wider variety of design choices so he can pick a style which best suits his personal taste.

An adjustable width window treatment according to this invention would include an overlay having a top edge adapted to be suspended from a support device mounted above a window. The overlay provides a decorative covering for at least a portion of the window. A plurality of fastener tabs extend upward from the top edge of the overlay. Adjacent tabs are separated by gaps extending along the width of the top edge of the overlay. Each fastener tab has a front and a rear surface with a first fastener means located on the front surface and a second fastener means located on the rear surface. The first fastener means is attachable to the second fastener means. The overlay can be folded at any lateral position along the gaps so that the adjustable window valance can be adjusted to fit windows having different widths. Adjacent fastener tabs are spaced apart so that a second fastener means on the rear surface of a first tab can be attached, in overlying relationship, to a first fastener means on an adjacent second tab when the overlay is folded along a lateral position of a gap between the first and second tabs.

BRIEF DESCRIPTION OF THE DRAWINGS

FIG. 26G is a view of the rear, lining side of the Adjustable-Width Jabot in its folded position showing the 2 parallel rows of fastener across its folded width.

FIG. 26L is a view of a jabot attached to the rear of the rod sleeve.

DETAILED DESCRIPTION OF THE PREFERRED EMBODIMENTS SYSTEM COMPARISON

Figure 1A:
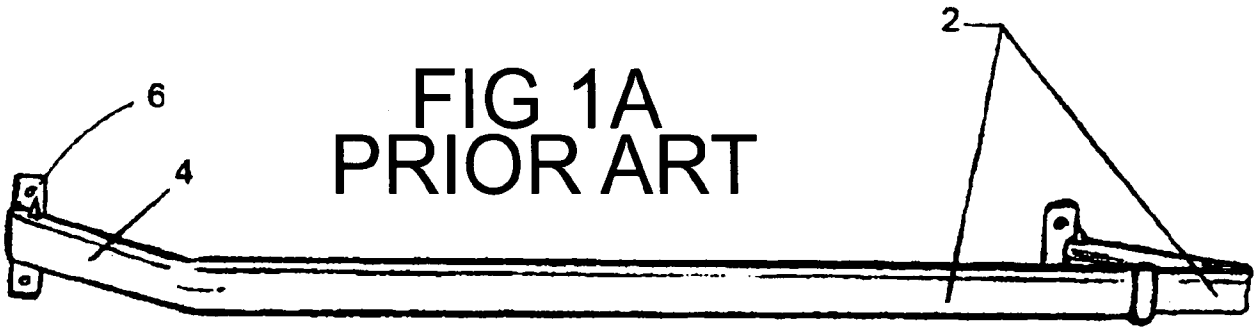
FIG 1A PRIOR ART
FIG. 1A shows a conventional prior art Lockseam Curtain Rod from which the components of this window treatment system can be hung.
Figure 1B:
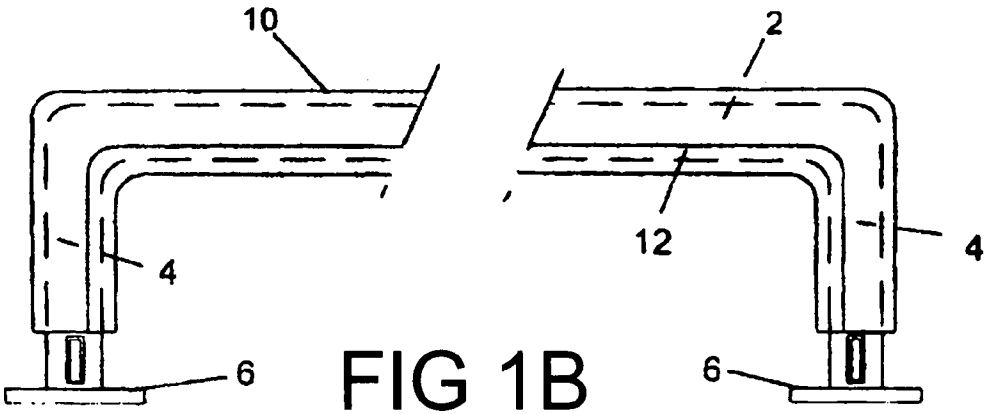
FIG 1B PRIOR ART
FIG. 1B shows a rod sleeve fabricated from a strip of fabric positioned on the curtain rod.
Figure 2:
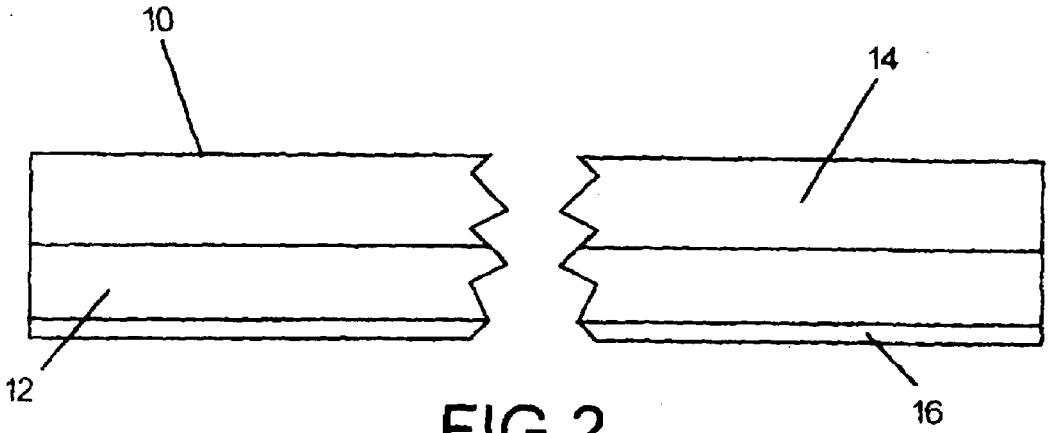
FIG 2 PRIOR ART
FIG. 2 is a view of a strip of heavy-duty fabric with a hook fastener mounted thereon. This strip of fabric is used to form a rod sleeve that can be used on a conventional curtain rod of the type shown in FIG. 1A.
Figure 3:
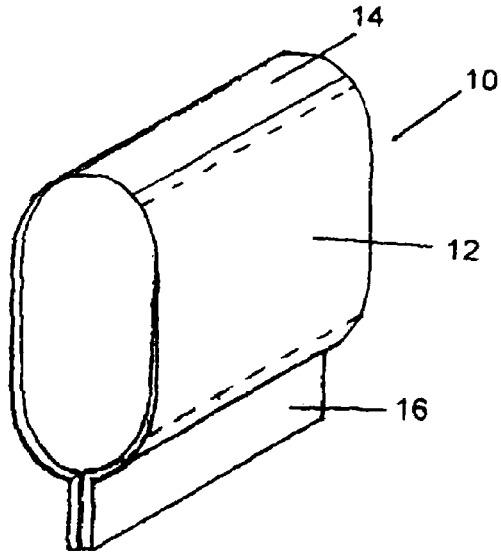
FIG 3 PRIOR ART
FIG. 3 is a view of a rod sleeve fabricated from the strip of fabric shown in FIG. 2.

The common curtain rod of FIG. 1A with the Rod Sleeve as shown in FIGS. 1B, 2, 3 and 4 of U.S. Pat. No. 6,732,783 form the support device for the mounting of the Adjustable-Width Swag of the instant invention. This support device can be used to display other valance components which have the mating hook and look fastener attached to them so they adhere to the fastener of the Rod Sleeve. Conventional rod 2 includes a return section 4 and a mounting member 6 at each end. The width of the conventional rod can be adjusted by sliding the telescoping sections. A rod sleeve 10 can be mounted on the rod 2. Rod sleeve 12 comprises a fabric sleeve 14 with a continuous hook fastener 12 extending between opposite ends. Edges 16 are sewn together so that a flat fabric can be formed as a sleeve.

Besides the Adjustable-Width Swag with its folds/gathers/pleats, there are other popular styles of valances which are available only to the customer who can afford the custom workroom because these styles have to fit the window precisely and are often mounted on a board which has been cut to fit that particular window treatment exactly.

There is a need for features appropriate to this system which would allow an onsite adjustability of both width and height to as many of these other types/styles of valance components as possible in order to give a more complete offering of the designs people want for their window treatments.

Figure 5:
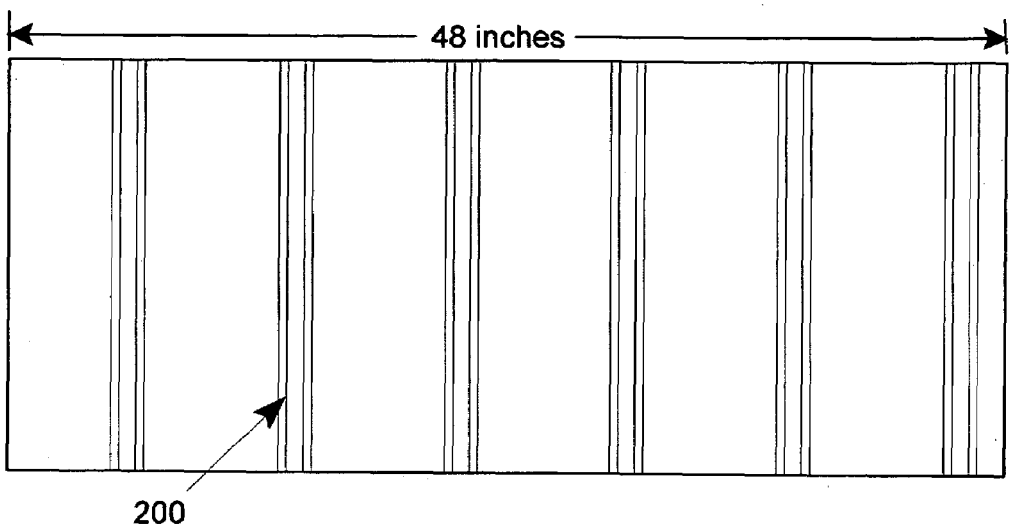
FIG. 5 is a view of a traditional Roman overlay.
Figure 8:
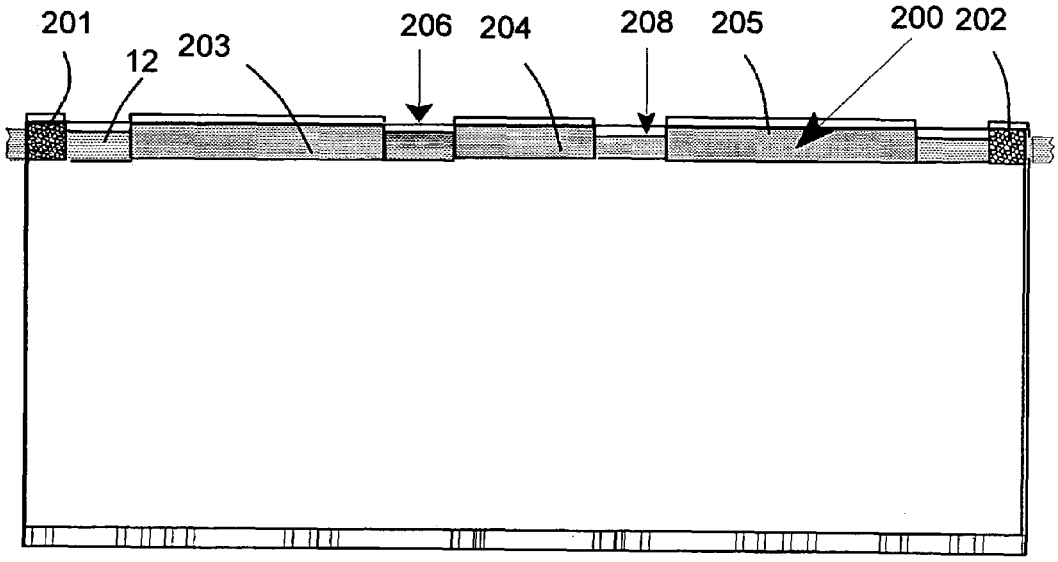
FIG. 8 is a full, rear view of the Adjustable-Width Roman Overlay mounted on a Rod Sleeve.

One of these popular valance styles is properly called a Roman Valance or Roman Overlay. The main component of this valance, as seen in FIG. 5, is a flat piece of fabric that has been cut and sewn to a specific size (48" in this model). If this piece could be narrowed in width on its sides by the customer and maintain the custom-fit look peculiar to a Roman Valance, it could accommodate any single window from 30-42" in width. If this same flat valance component could also be narrowed within its body to form folds, pleats, and even allow a vertical adjustment, it would not only fit more window sizes, it would also offer more valance styles such as a box pleated valance, an inverted pleat valance, a Murphy valance and more. The standardization of these flat pieces facilitates the mass production of valance components that, having appropriate adjustable-width/adjustable style features for an onsite fit and design selection, can provide many different styles of valances giving that coveted, board mounted look at much reduced prices.

The Adjustable-Width Overlay

Figure 6:
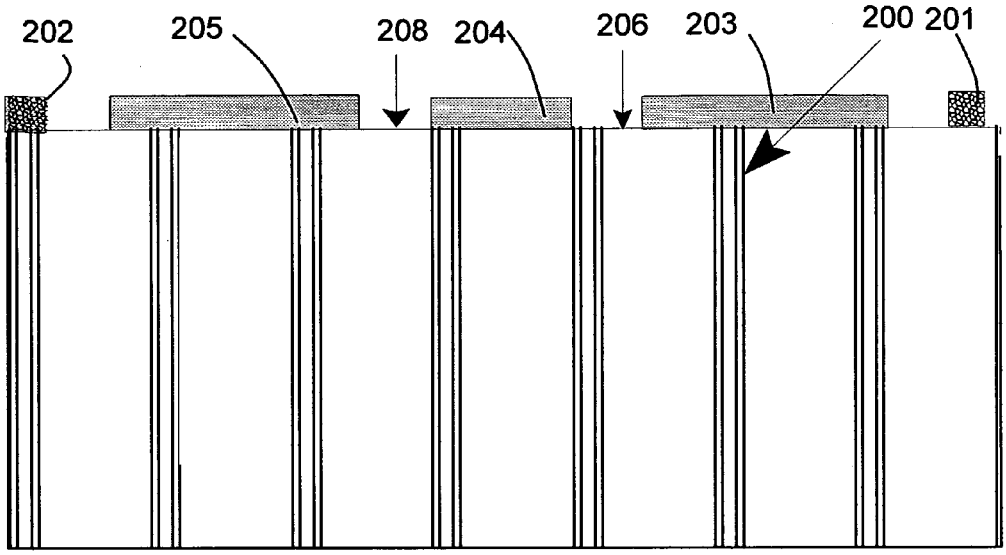
FIG. 6 is a view of the front of the Adjustable-Width Roman Overlay showing the various tabs and segments spaced across the top to be used for altering its width and style.
Figure 7:
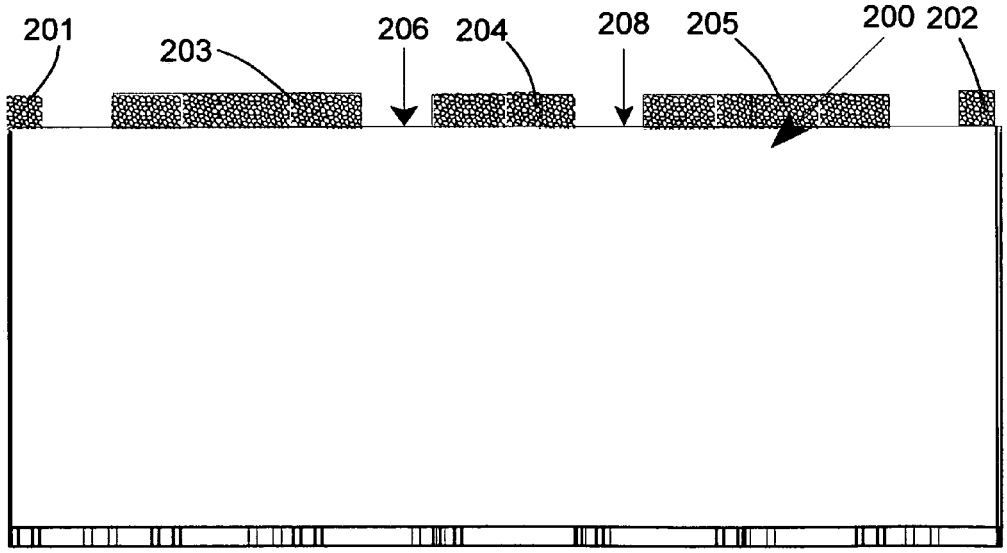
FIG. 7 is a rear view of the same Adjustable-Width Roman Overlay as in FIG. 6.

The Roman overlay 200 shown in FIG. 5 is one of many shapes of flat overlays which can be constructed to allow not only an adjustability of width, but of design also. FIGS. 6 and 7, showing the front and rear views respectively of this 48" overlay 200 show an example of one configuration pattern of hook and loop fasteners along the top edge to permit this adjustability of width and change of style. There is a loop tab 201, 202 on each edge as well as segmented fasteners 203, 204, 205 separated by gaps 206 and 208 spaced along the upper top edge. In this embodiment, loop fasteners 209, 210, 211 comprise the back of each segment on the rear side of the Overlay 200. Correspondingly, hook fasteners 212, 213, 214 comprise the front of each fastener segment on the front side. See FIGS. 6 and 7. The tabs are of loop fastener on both the front and rear sides.

This overlay 200 may be mounted on the support device at its maximum width of 48" in this embodiment by (1) laying the top edge of the rear side of the overlay in a flat and taut manner across the top ledge formed by the support device, and (2) folding the tabs and fastener segments down onto the corresponding spot of the mating fastener on the rear of the support device. The tabs and segments, once mated to the fastener on the support device, will secure the entire piece to hang from the top of the rod/rod sleeve and it will look as though it were hanging from a board as seen in FIGS. 5 for the front view and 8 for the rear view.

Figure 9:
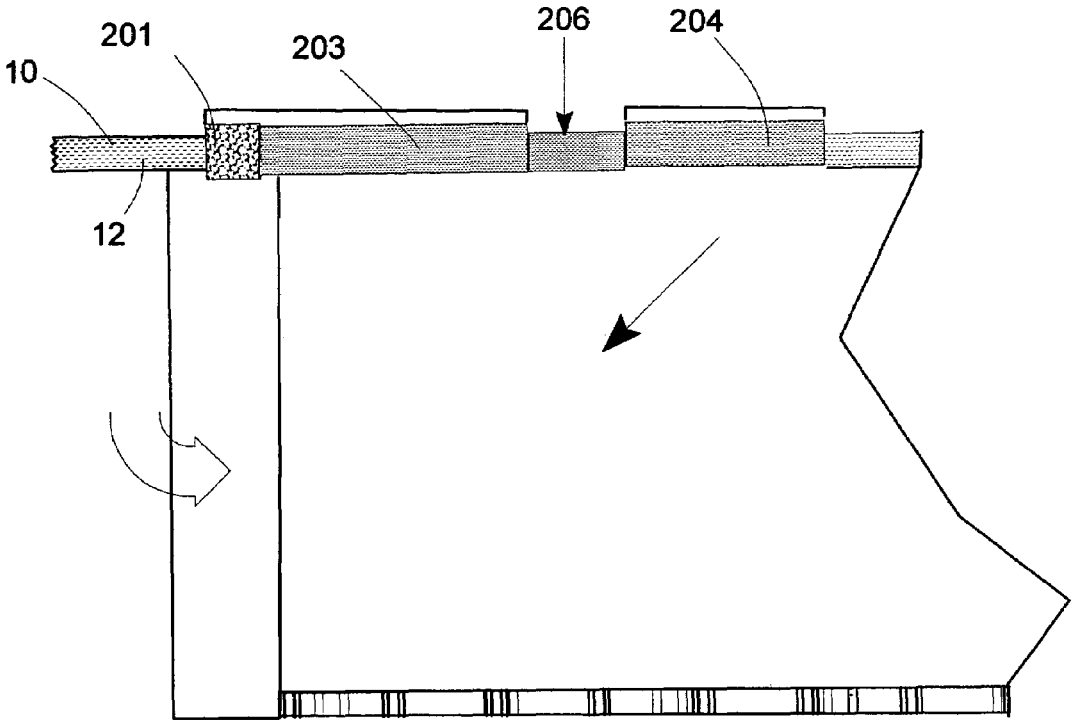
FIG. 9 is a close-up, rear view of one side of the Adjustable-Width Roman Overlay mounted on a Rod Sleeve showing a 2" end fold which has been secured by a tab fastener.
Figure 10:
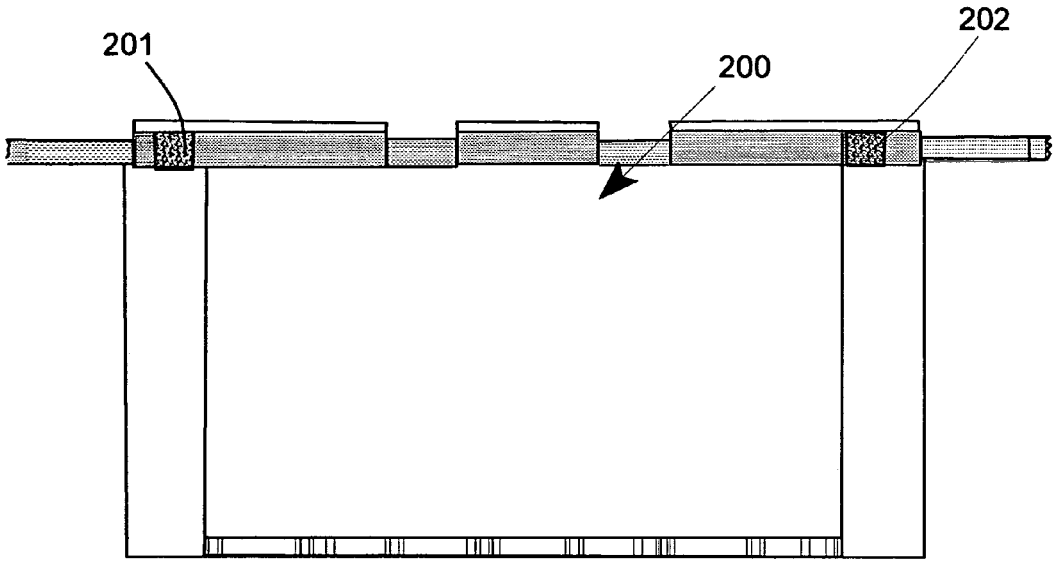
FIG. 10 is a rear view of the Adjustable-Width Roman Overlay mounted on a Rod Sleeve showing 2" folds secured by the tab fasteners on each end.
Figure 11:
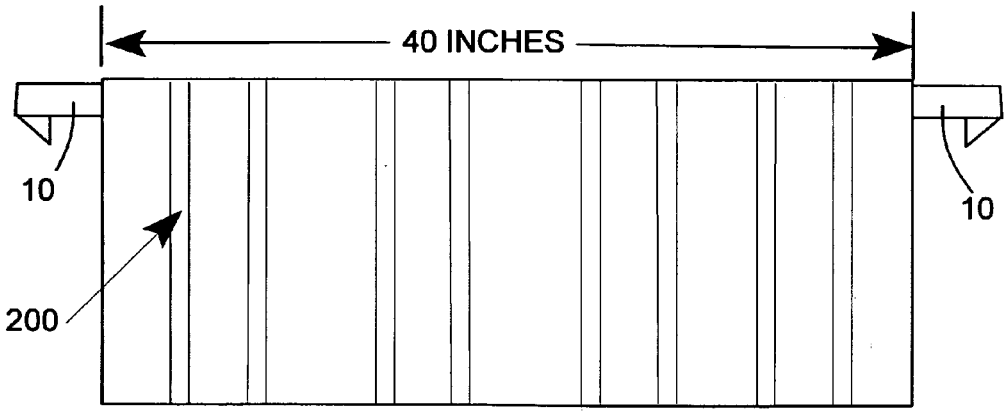
FIG. 11 is a full, front view of the same Adjustable-Width Roman Overlay as in FIG. 10.
Figure 12:
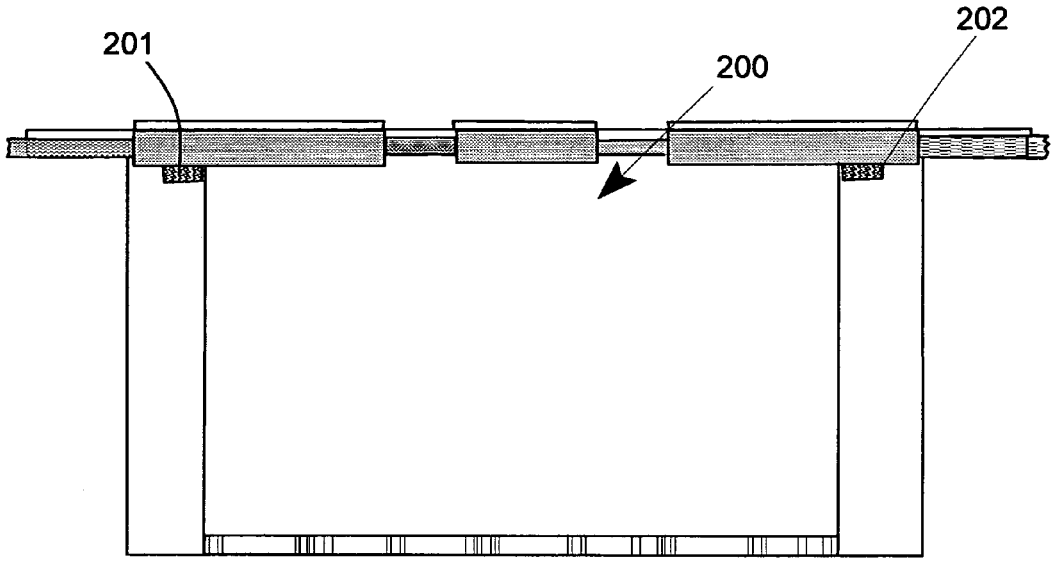
FIG. 12 is a full, rear view of the Adjustable-Width Roman Overlay mounted on a Rod Sleeve with 4" folds on each end secured by tab fasteners which are partially hidden by the overlying fastener segment.
Figure 13:
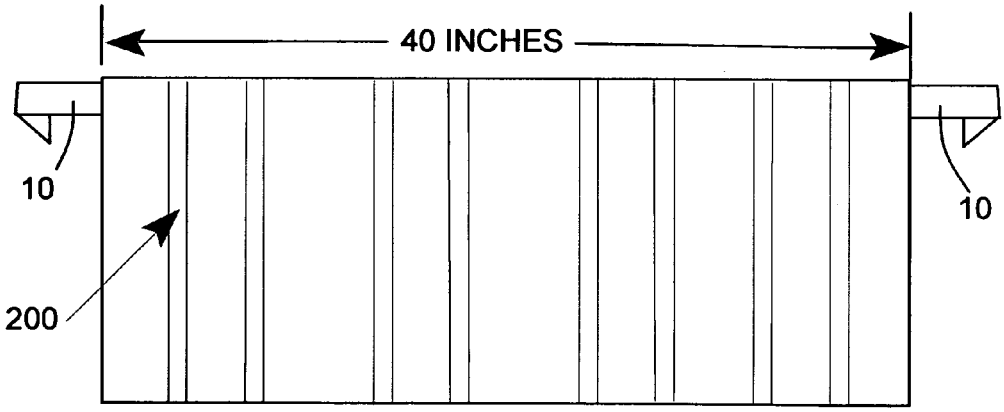
FIG. 13 is a full, front view of the same Adjustable-Width Roman Overlay as in FIG. 12.

The valance piece may be narrowed from 1"-4" (at least) per end by merely folding the ends back the desired amount (1"-4" in this embodiment), making a vertical fold the entire length of the piece, and then suspending each fold formed by means of the end tab (which need be no wider than 1" for a secure attachment.) The tabs on the Adjustable-Width Overlay 200 have loop or hook fastener on both the front and back so they will mate with the fastener of the Rod Sleeve 10 (or an underlying valance section) whether the said overlay 200 is in the folded or unfolded position. FIGS. 9 and 10 show tab 201 mating with the Rod Sleeve 10 to secure a 2" fold on the end of the overlay 200. In the preferred embodiment, loop fasteners on both sides (i.e., front and rear) comprise the tabs 201 and 202. (See FIGS. 6 and 7.) For minor adjustments in the width of the overlay 200, each vertical edge is folded over beneath the adjacent section of the overlay 200. FIG. 10 shows the formation of 2" folds on the back, lining side of the overlay. FIG. 11 shows the front view of the valance narrowed two inches per end for a total of 4". The tabs 201 and 202 still extend above the fabric and can be folded over the Rod Sleeve 10 where they can be attached to the mating fastener of the Rod Sleeve 10 as seen in FIG. 10. This will allow width adjustments of up to approximately two inches in the preferred embodiment. For larger adjustments of up to approximately four inches in the preferred embodiment, the edge section can be folded over with the tabs 201 and 202 underlying (and mostly concealed/covered by) the adjacent segmented fastener as shown in FIG. 12. Both the segmented fastener and the tabs mate to the fastener of the Rod Sleeve/curtain rod with hook/loop fastener. FIGS. 12 and 13 show the back and front views respectively, with the ends folded back 4" each. The tabs holding up the turned-back sides are half-hidden under the top fastener segments as is also shown in FIG. 12. The tabs make it possible to fold back and secure each end at least 4", narrowing the total width at least 8 inches.

Figure 14:
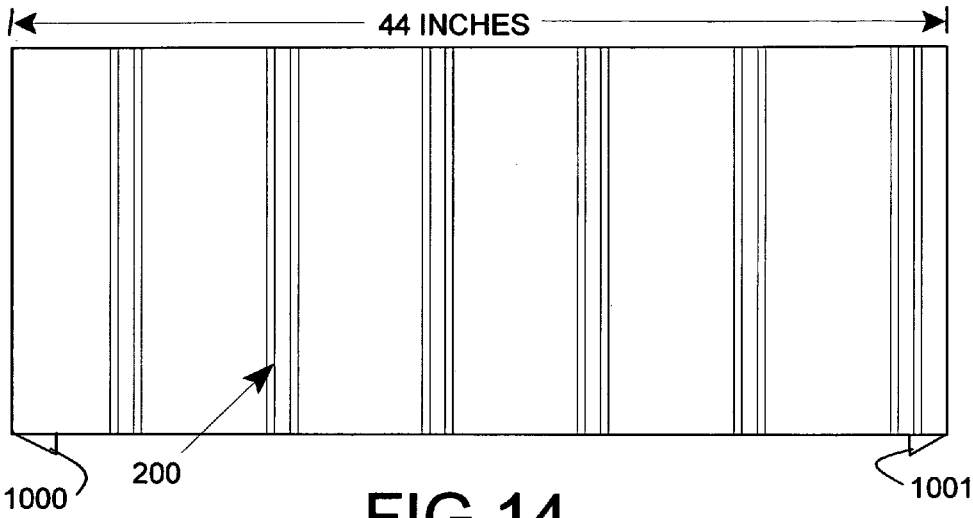
FIG. 14 is a front view of an Adjustable-Width Roman Overlay with end folds which show at the hem area giving an unprofessional look to the treatment.
Figure 15:
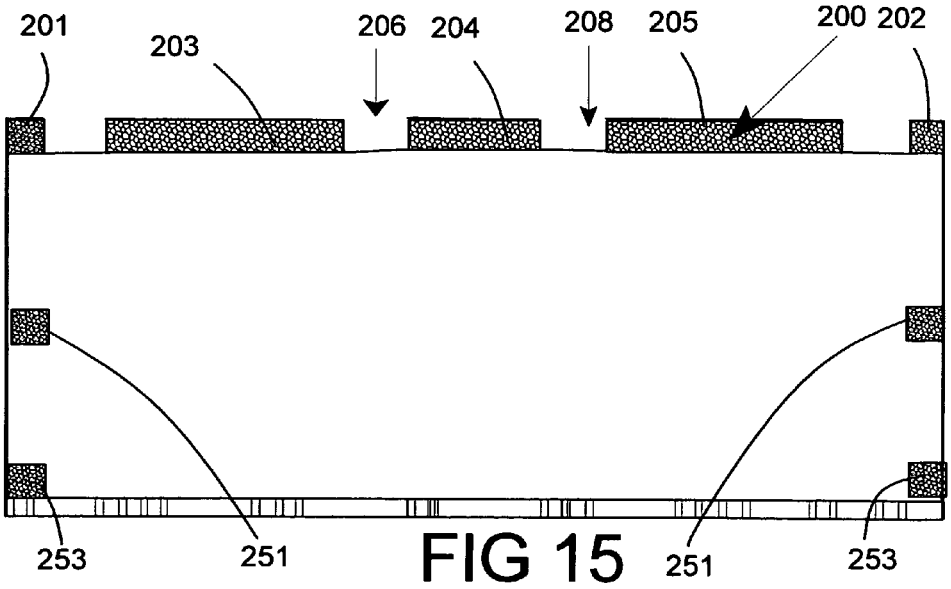
FIG. 15 is a rear view of the Adjustable-Width Roman Overlay with hook and loop fastener dots placed on each end.

When the ends of the valance section are folded back only 1-2" each, they will probably not lie flat against the back of the main body of the section causing an unsightly and unprofessional look 1000,1001 to the viewer as is seen in FIG. 14. This problem is overcome by applying 1-3 adhesive hook and loop fastener dots 251 and 253 along the vertical edge (see FIG. 15) especially at the bottom where the flap formed by the fold needs to be snugly against the back of the valance section so the flap "disappears" from sight. (These dots are commonly sold as pairs with both the loop and hook dots having an adhesive on their backs with each adhesive area covered by a removable piece of paper. To apply the dots one needs simply to mate the dots and then remove the protective paper from one side of as many of the mated dots as needed and press that uncovered adhesive side onto the vertical edge/the bottom corner as in FIG. 15. With the desired number of mated dots in place (i.e., on the lining side in this embodiment, very close to each vertical edge of the valance piece,) remove the protective paper from the back of the remaining piece(s) of the mated fastener dot pair(s) and fold each end of the valance piece back the appropriate amount to fit the window or give the desired style. Then sufficiently press the hook/loop fastener dot(s) to the backside of the valance piece so that the adhesive adheres to the lining. These mated dots will hold the flaps back sufficiently to obtain a crisply folded edge and so that no flap shows to the viewer as he looks up. See FIGS. 11 and 13 for the corrected view with its professional look. Alternatively, the customer may opt to solve this problem with glue, pins, a needle and thread, or whatever means she chooses.

These window treatment overlays are also able to bend around the elbow of the rod (see FIGS. 1 and 4) and form their own return (a common term applied to that part of a rod or valance which extends from the wall out into the room to the corner of the rod/valance.) Even if the overlay has been folded back on its ends to narrow its width the 1"-4" as mentioned above, this double layer may still be wrapped around the elbow of the rod and the tabs and segments will properly secure the valance piece in that return position also.

Figure 16:
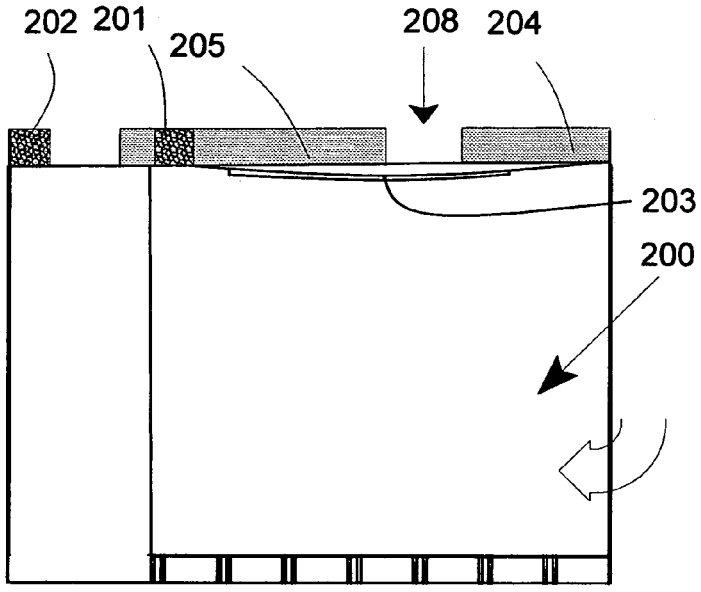
FIG. 16 is a view of one of the vertical folds made in the center area of the Adjustable-Width Overlay to produce an Inverted Pleat on its front side.
Figure 17:
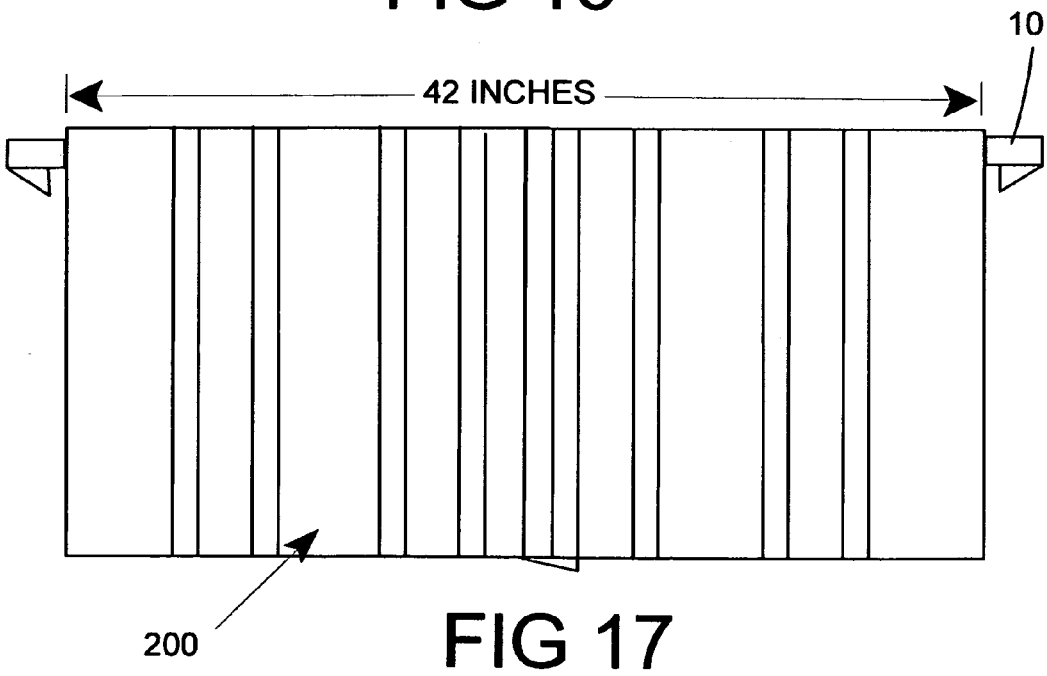
FIG. 17 is a full, front view of the first pleat formed toward making an Inverted Pleat on the front of the Adjustable-Width Overlay.
Figure 18:
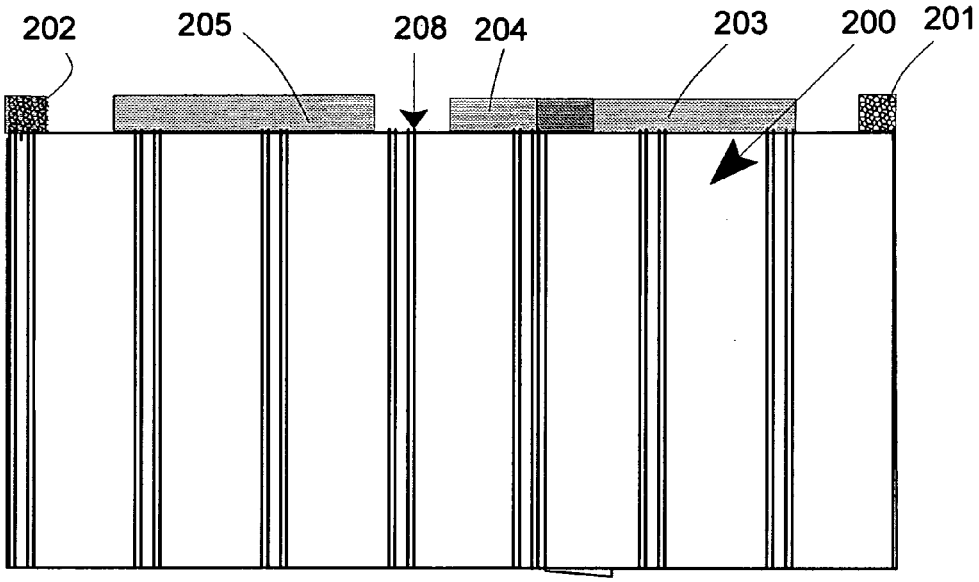
FIG. 18 is a view of the front of the Adjustable-Width Overlay showing the overlapping, mating segments of hook and loop fastener which enable the pleat to be secured.
Figure 19:
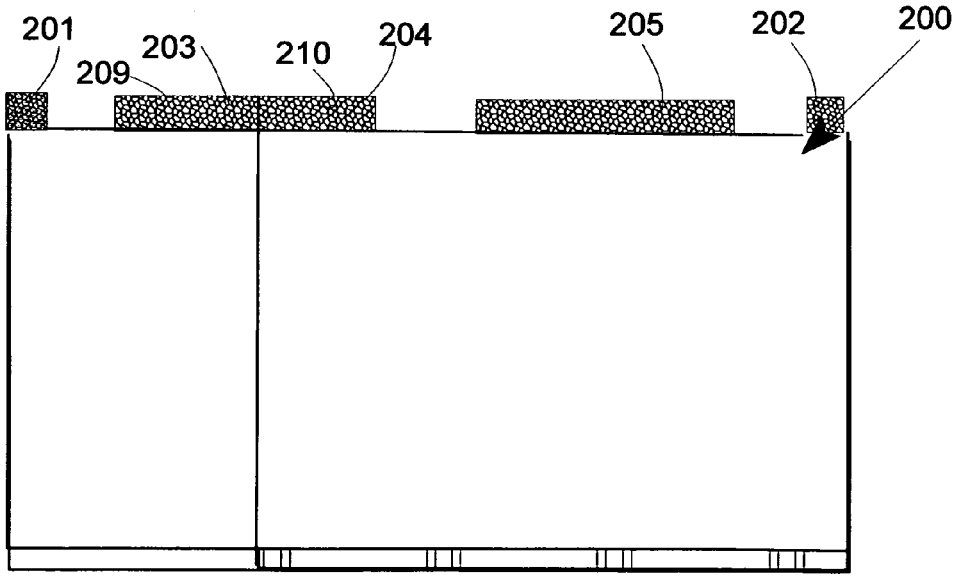
FIG. 19 is a rear view of FIG. 18 showing the mating of the hook and loop fastener segments, which secure the pleat.

These spaced segmented fasteners also allow a change of width and design within the body of the piece by forming pleats. FIGS. 16 and 17 show the formation of one such pleat. The entire valance piece is folded along a vertical fold extending from one end of fastener segment 204 as in FIG. 16. The valance piece is then folded in a reverse orientation along a fold extending from an end of fastener segment 203. See FIGS. 18 and 19, which show the front and rear views respectively. This will mate a loop fastener adjacent to a hook fastener so that a secured pleat is formed.

Figure 20:
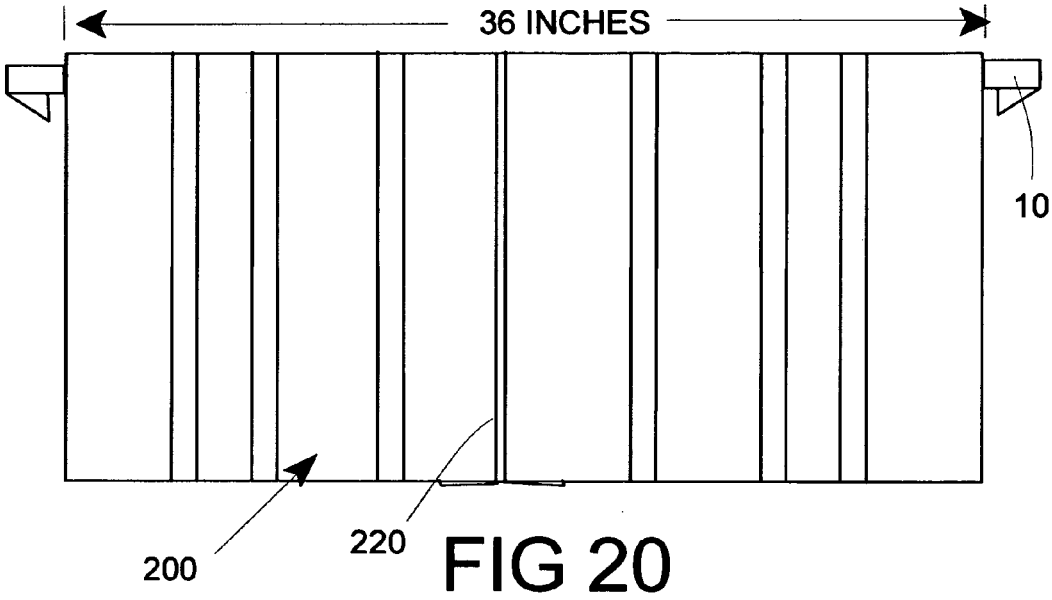
FIG. 20 is a view of the Adjustable-Width Overlay with a fully formed Inverted Pleat on the front.
Figure 21:
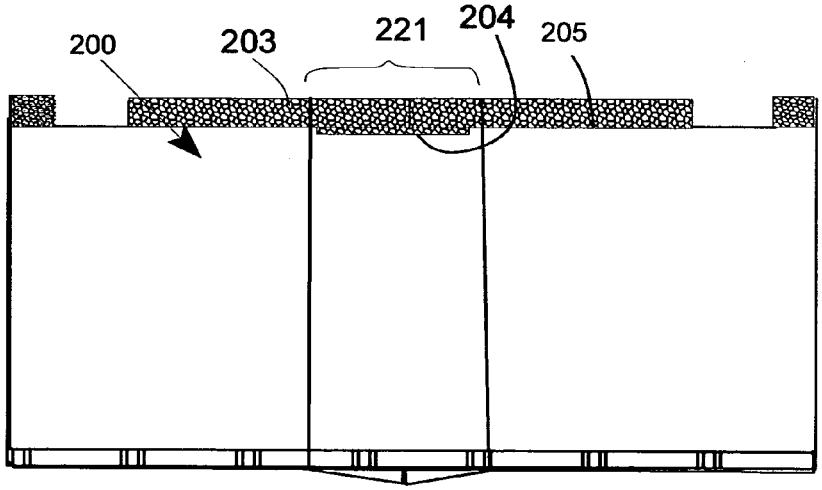
FIG. 21 is a rear view of the Adjustable-Width Overlay showing the hook and loop fastener placement to secure each pleat and the box pleat which is formed on the lining side.
Figure 22:
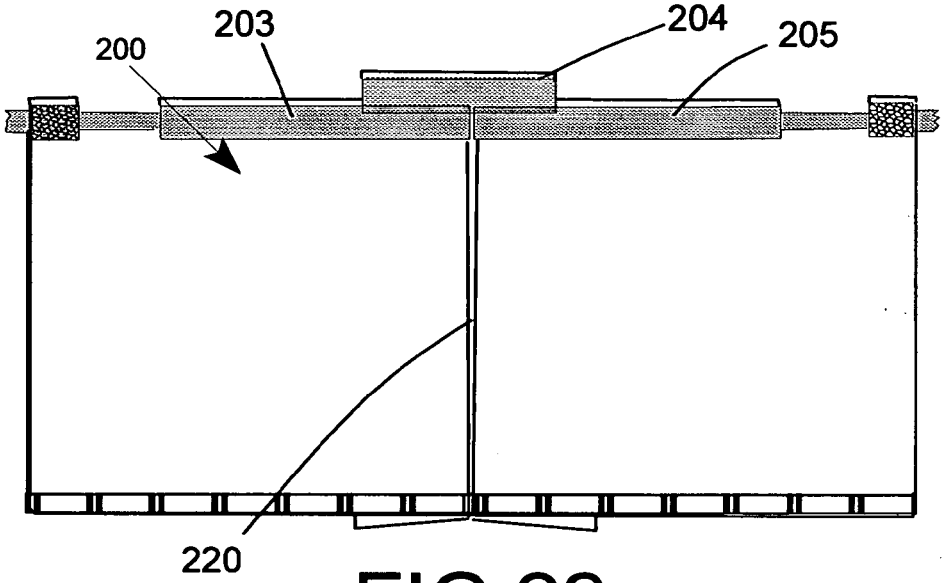
FIG. 22 is a rear view of the placement of the hook and loop fastener segments on the Adjustable-Width Overlay to obtain a box pleat on the front with the corresponding inverted pleat on the lining, the rear side.
Figure 23:
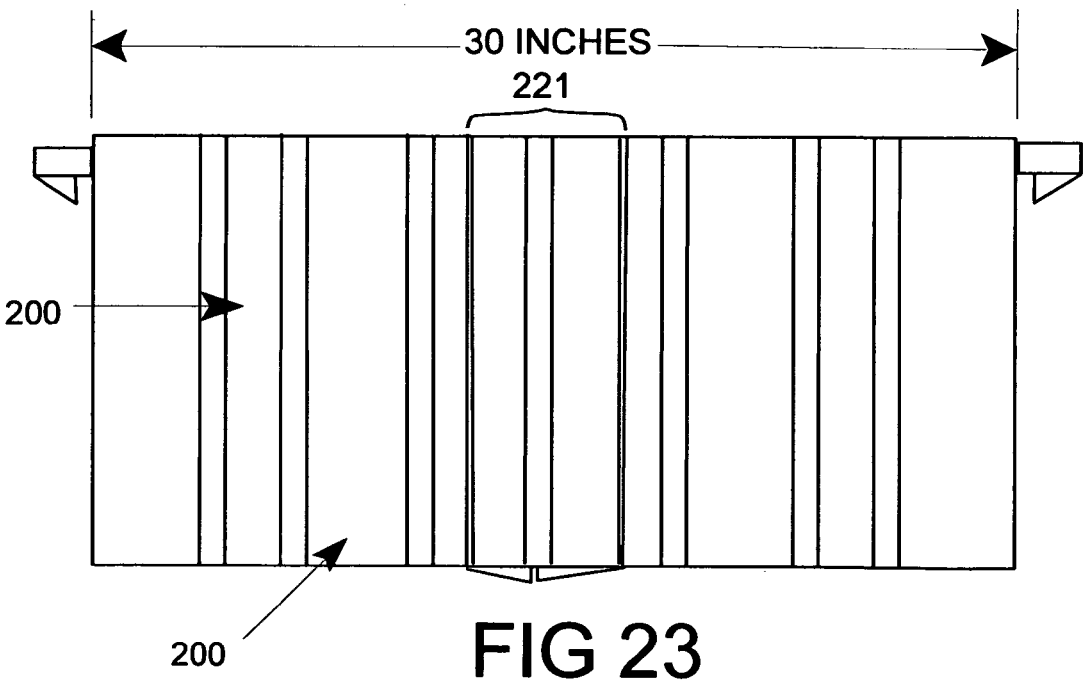
FIG. 23 is a view of the front of the Adjustable-Width Overlay of FIG. 22 with the box pleat formed at the center.
Figure 24A:
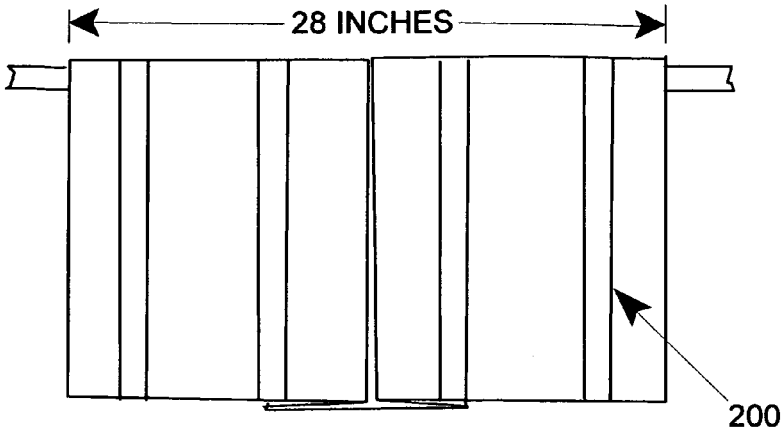
FIG. 24A is a view of the Adjustable-Width Overlay mounted at its narrowest width via 4" end folds and an inverted pleat in its center.
Figure 24B:
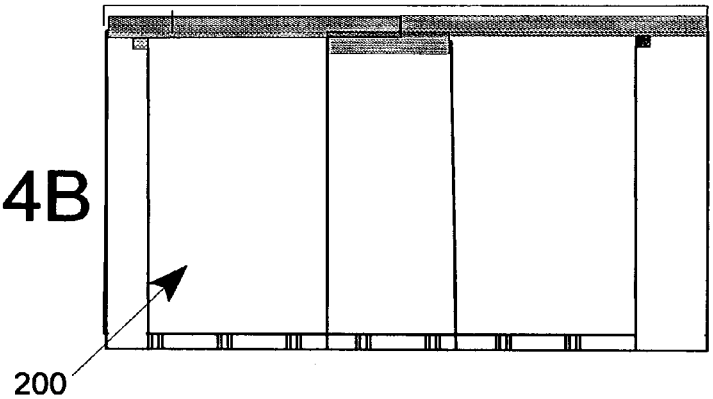
FIG. 24B is a rear view of FIG. 24A showing the 4" end folds secured by their tabs and the corresponding box pleat formed on the lining side by the placement of the fastener segments.

An adjoining loop fastener section formed from portions of loop fastener strip segments 209 and 210 will be exposed on the back surface on opposite sides of the pleat. See FIG. 19. When both pleats (the other pleat being formed by mating the hook fastener of segment 205 with the loop fastener of segment 204) are formed in this manner, the Inverted Pleat Overlay 200 shown in FIG. 20 results. When folded in this manner an inverted pleat 220 is formed on one surface while a box pleat 221 is formed on the other surface. FIG. 21 shows the mounted box pleat 221 formed on the rear, lining side. FIG. 23 gives the front view of the Box Pleat Overlay 200 and FIG. 22 gives the rear view of FIG. 23 with its lining in an Inverted Pleat 220. The appropriate box or inverted pleat can thus be formed on the exposed surface of the newly styled Adjustable-Width Overlay 200 according to the desire of the decorator. Either of these looks provides a major adjustment to the width as well as a new design element. By making these two 3" deep folds, what was once (in this particular example) a 48" flat overlay 200 has become a 36" width pleated overlay 200. It can be reduced even more by folding the ends in (via the tabs) 4" each to an overall finished width of 28 inches! See FIGS. 24A for the front view and 24B for the rear view of this same overlay 200 in the 28" width.

Figure 21A:
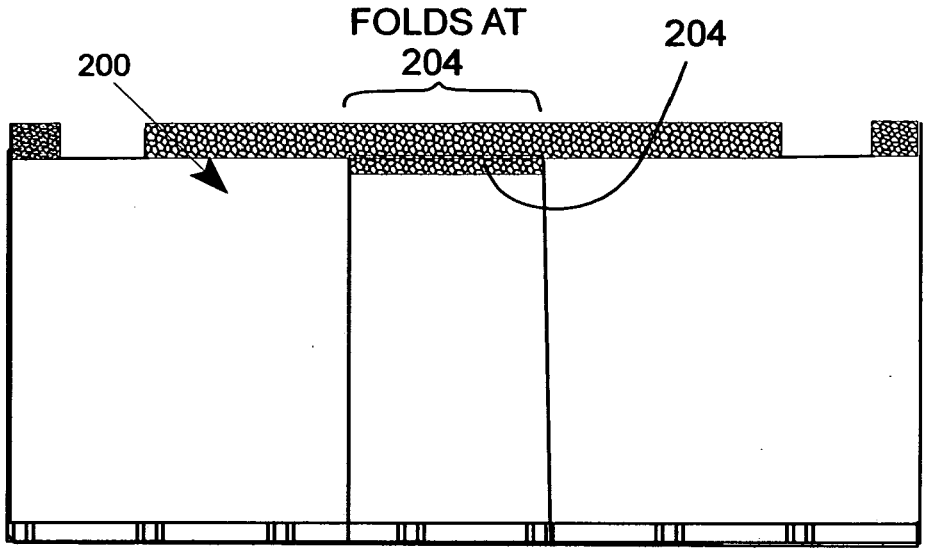
FIG. 21A is a view of the rear folds placed at the edges of the center fastener segment of the Adjustable-Width Overlay.
Figure 21B:
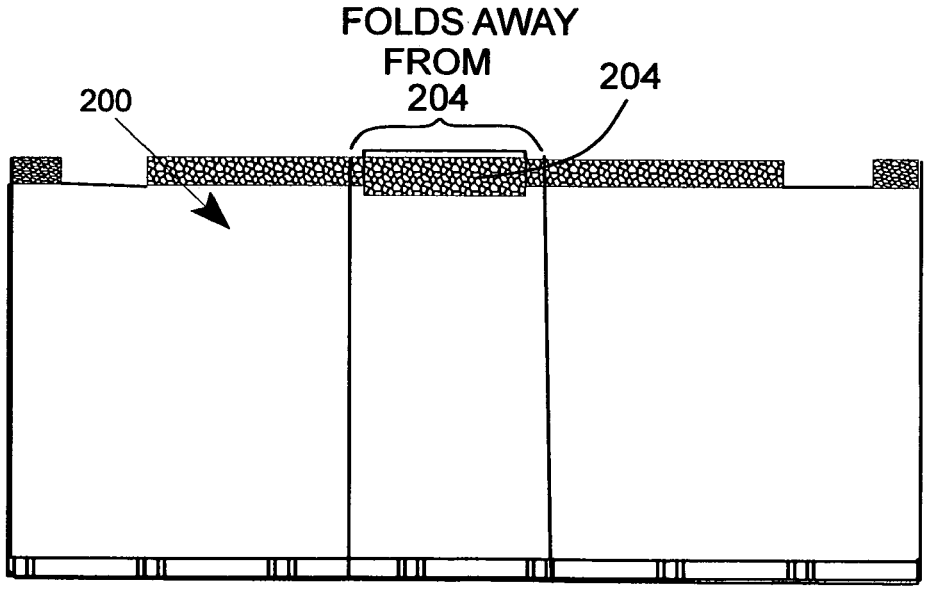
FIG. 21B is a view of the rear folds placed 1" away from the edges of the center fastener segment of the Adjustable-Width Overlay.
Figure 24C:
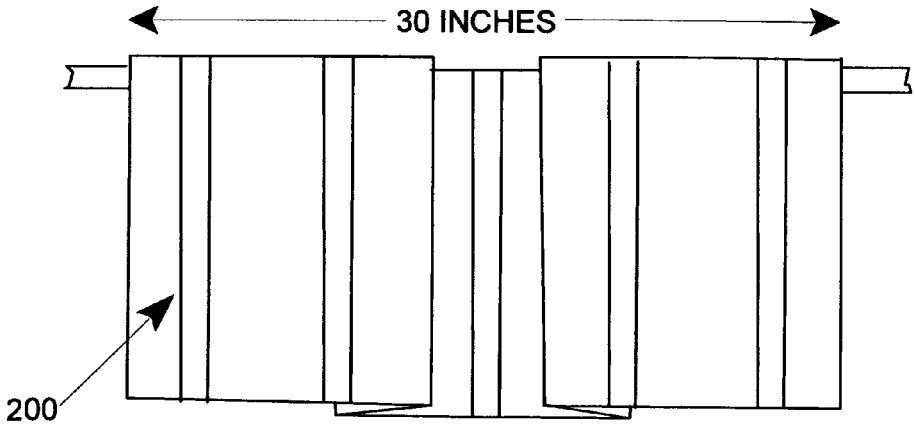
FIG. 24C is a view of the front of the Adjustable-Width Overly in which pleats have been formed, which do not meet in the center, but are separated by about 2" giving another beautiful style available with the overlay.

It is not necessary to form these folds so that they are aligned with the edges of fastener segment 204. FIG. 21A shows the rear view of a folded overlay 200 in order to clearly display the folds aligned with the fastener segment. The folds can be spaced from the edges of this segment 204 as in FIG. 21B which shows the folds about 1" from the edges of segment 204. FIG. 24C shows the front view of the Adjustable-Width Overlay 200 with each end folded back 4" and with the inner opposing vertical folds spaced about 1" each from the center. This gives a different look for the pleated valance and increases its width (from 28" to 30".)

Figure 25:
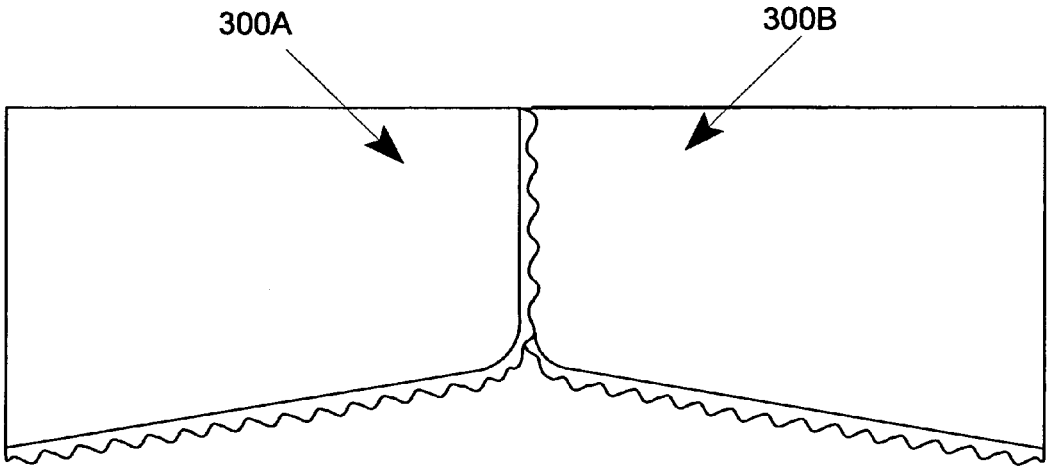
FIG. 25 is a view of a valance style formed by a pair of opposing Adjustable-Width Overlays with shaped hemlines and whose short ends abut in the center.
Figure 25A:
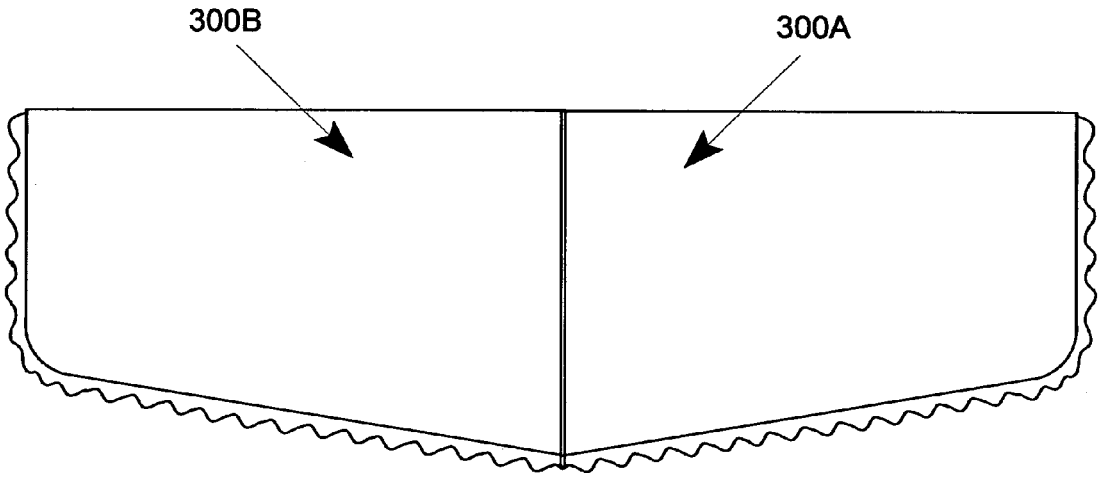
FIG. 25A is a view of a valance style formed by the same pair of Adjustable-Width, Shaped-Hem Overlays as in FIG. 25 but with the opposite, long ends abutting in the center.
Figures 25B, 25C, 25D:
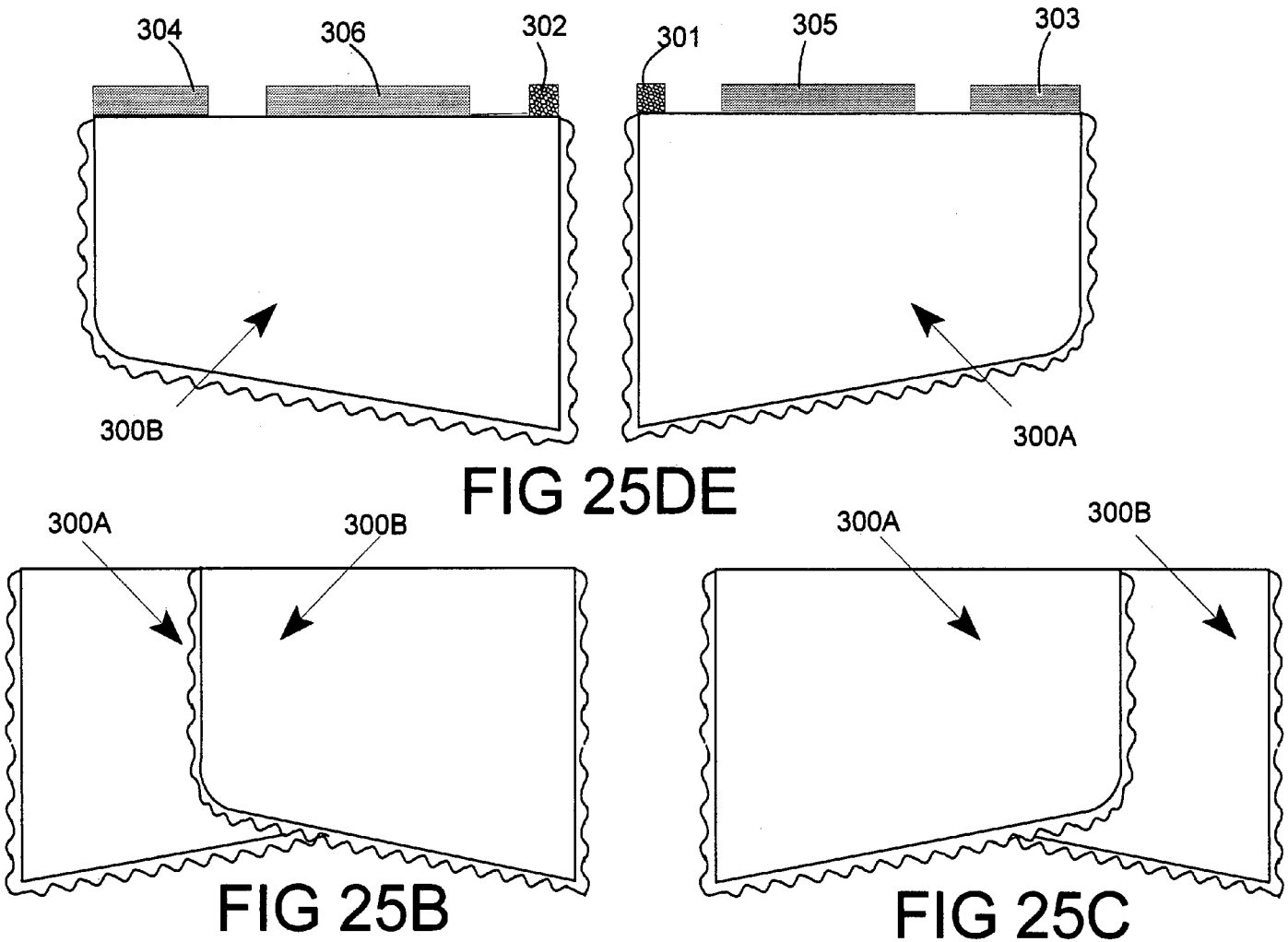
FIG. 25B is a view of a valance style formed by overlapping the same pair of Adjustable-Width, Shaped-Hem Overlays.
FIG. 25C is a view of a valance style formed by overlapping the same pair of Adjustable-Width, Shaped-Hem Overlays as in FIG. 25B, but the opposite section of the pair is on the top of this treatment.
FIG. 25DE is a front view of the pair of Adjustable-Width, Shaped-Hem Overlays showing the opposing configuration of tab and segment fastener placement on the top of each piece.
Figure 25F:
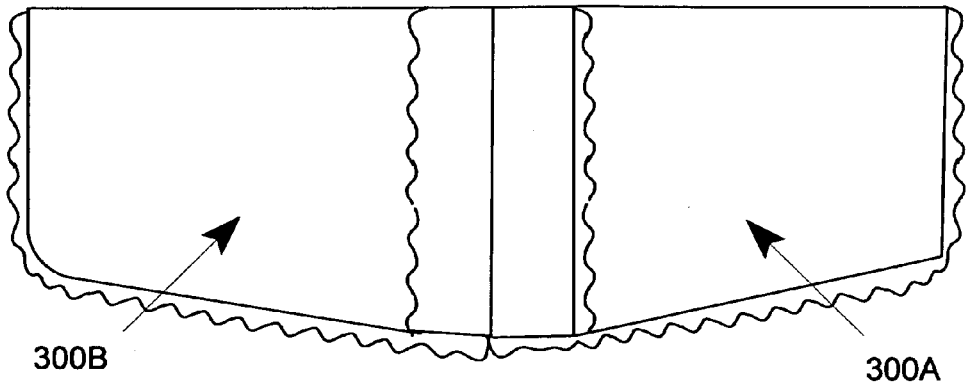
FIG. 25F is a front view of the pair of Adjustable-Width, Shaped-Hem Overlays whose opposite long ends have been folded to the front, showing the lining, and then placed so the newly formed folds abut one another on the Rod Sleeve.
Figure 25G:
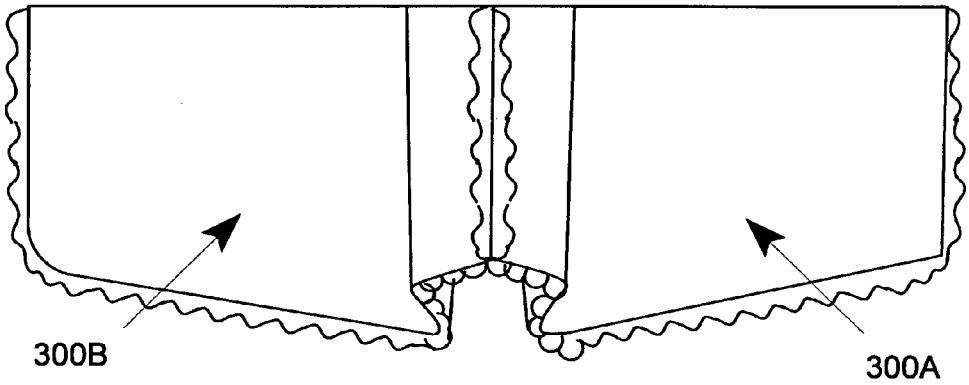
FIG. 25G is a front view of the pair of Adjustable-Width, Shaped-Hem Overlays in which pleats have been formed on the short ends which ends have been abutted at center to form a type of box pleat.
Figure 25H:
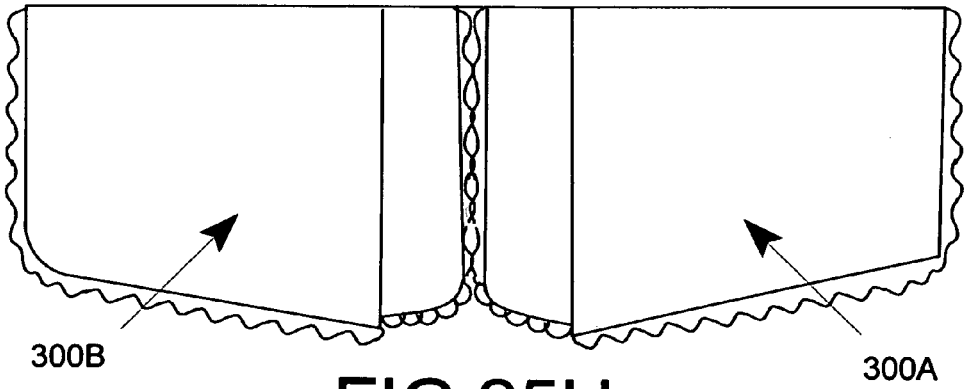
FIG. 25H is a view of the pair of Adjustable-Width, Shaped-Hem Overlays in which pleats have been formed on the short ends but in an opposite manner to FIG. 25K so that they form a type of inverted pleat on the front.
Figure 25I:
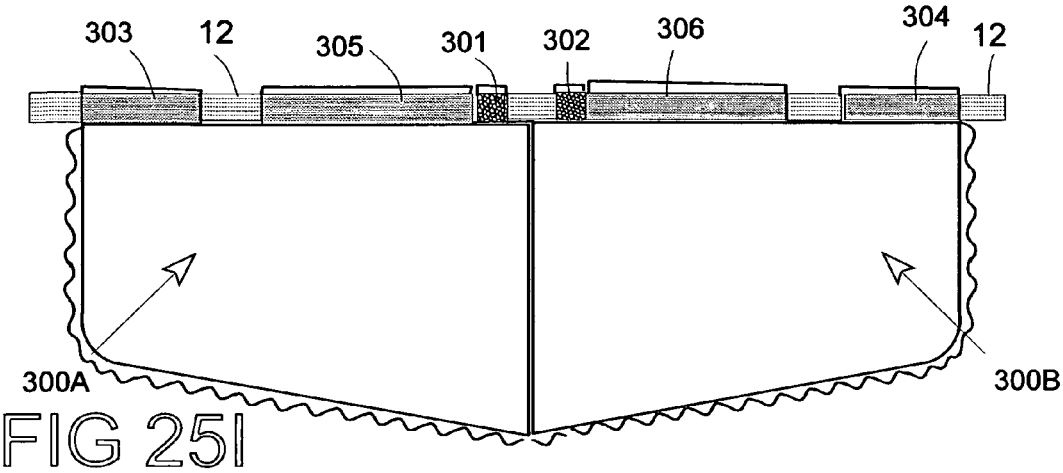
FIG. 25I is a close-up of a rear view of FIG. 25F showing the placement of the fastener tabs which achieve the center front folds.
Figure 25J:
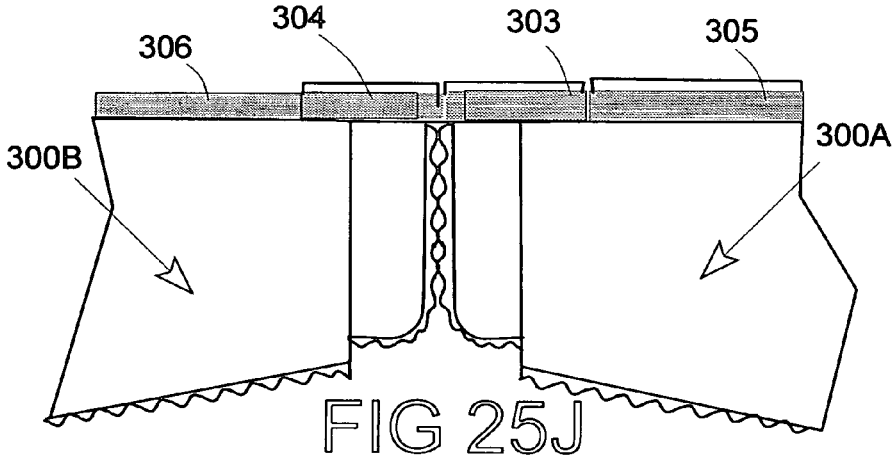
FIG. 25J is a close-up of a rear view of FIG. 25H, showing the placement of the fastener segments which achieves its box-pleat type center interest.
Figure 25K:
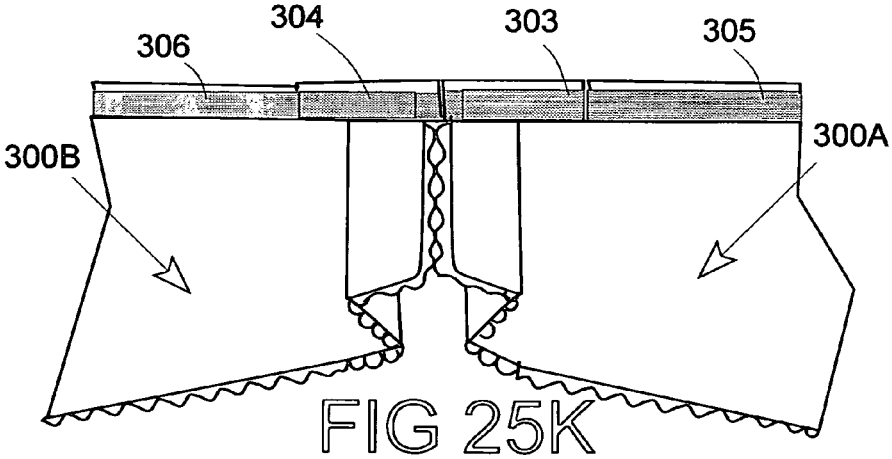
FIG. 25K is a close-up of a rear view of FIG. 25G, showing the placement of the fastener segments which achieves its inverted-pleat type styling at center.

An example of a simple valance which can be formed by two flat overlays 300A and 300B (which have, hem lines, unlike the straight hem line of the Roman overlay 200) is shown in FIG. 25. By reversing the right and the left overlays 300A and 300B, a different look can be achieved as in FIG. 25A. Of course, the same pair of overlays 300A and 300B may be mounted to overlap one another for narrower windows giving a chic, asymmetrical look as in FIG. 25. This asymmetrical look is very fashionable and complimentary when there are two windows on the same wall and the asymmetrical looks are done in opposing views as seen in FIGS. 25B and 25C. These same overlays 300A, 300B can be changed to form more complex valance styles, again, by means of the fastener tabs and segments, which allow placement of the overlays at virtually any position. FIG. 25DE gives the opposing configuration patterns of the fasteners along the top edge of this pair of overlays 300A, 300B. Using the loop fastener tab (301, 302 shown on FIG. 25DE) of each piece in the same lateral manner as previously described, the corresponding end of each overlay 300A, 300B has been folded as shown in FIG. 25F, but to the front, exposing the specially lined back side of the overlays giving an interesting decorative touch to the front while decreasing the width of each individual piece up to 4" in order to achieve the right size for the window. The small fastener segment of 4" (303, 304 in FIG. 25DE) applied on the top edge at the opposite end to the placement of the tab, allows the formation of a pleat that is both functional (for adjusting the width) and decorative. FIGS. 25G and 25H give examples of the two looks formed via lateral movement of these short end segments. FIG. 25G shows the box-pleat look formed when segments 303, 304 overlap their adjacent segments 305, 306 respectively. FIG. 25H shows a type of inverted pleat formed when the same segments 303, 304 are placed underneath their adjacent segments 305, 306, respectively. FIGS. 25I, 25K and 25J show close-ups of the rear views of FIGS. 25F, 25G, and 25H, respectively, so the fastener tabs and segments with their placement of the folds that achieve the various looks can be seen in their various positions. This feature again gives the customer design choices and narrows the overall width of the valance.

Figure 26:
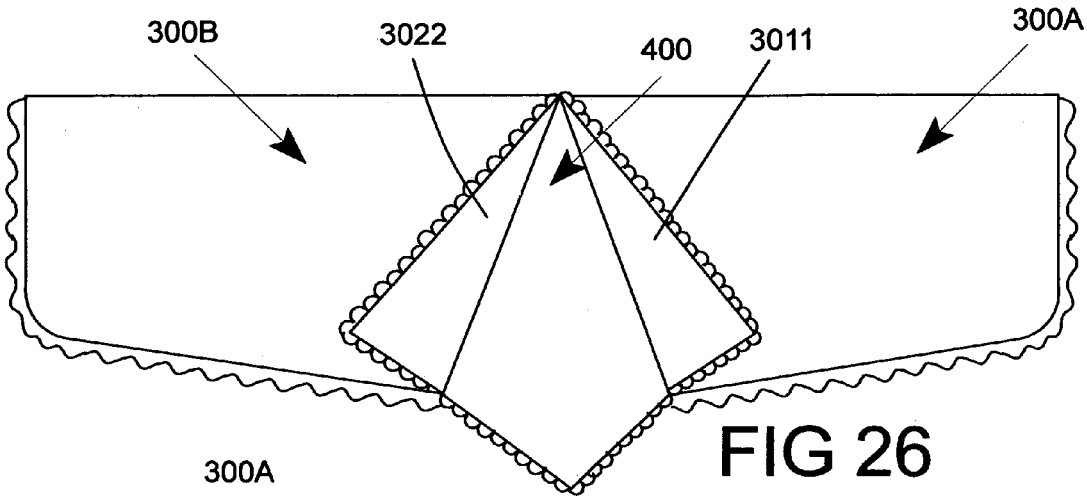
FIG. 26 is a view of a pair of barely overlapping Adjustable-Width, Shaped-Hem Overlays whose overlapping long ends have been turned to the front at an angle so the lining shows and then a jabot has been placed in the center underneath the overlapping pair of Overlays, filling in the empty space created by the angled ends.
Figure 26E:
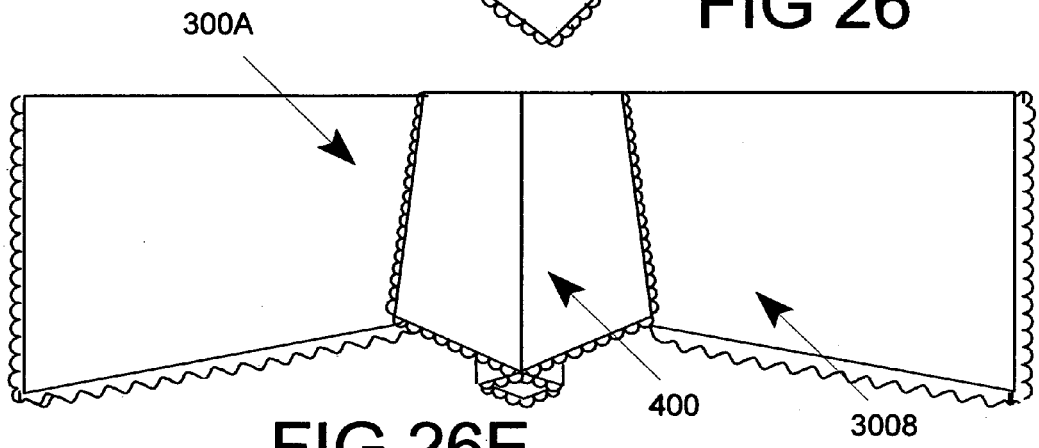
FIG. 26E is a view of a pair of Adjustable-Width, Shaped-Hem Overlays with a folded, decorative Adjustable-Width Jabot at center.
Figure 26F:
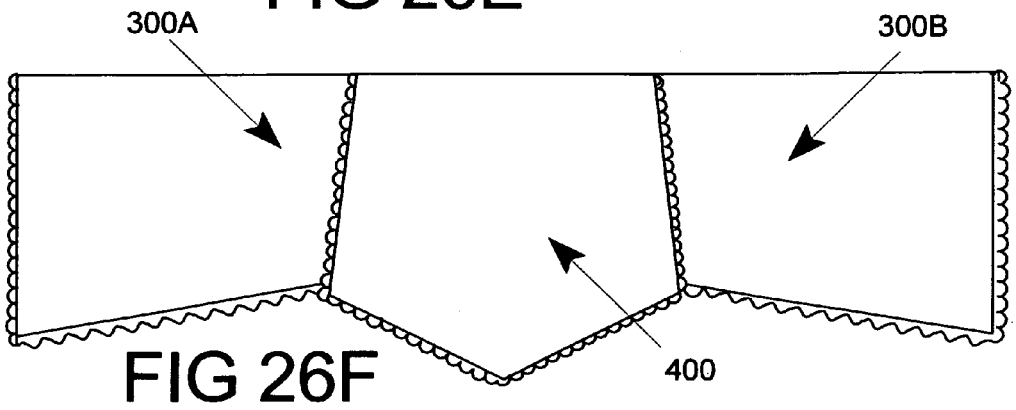
FIG. 26F is a view of a pair of Adjustable-Width, Shaped-Hem Overlays with the Adjustable-Width Jabot fully spread at the center of the treatment.
Figure 26A:
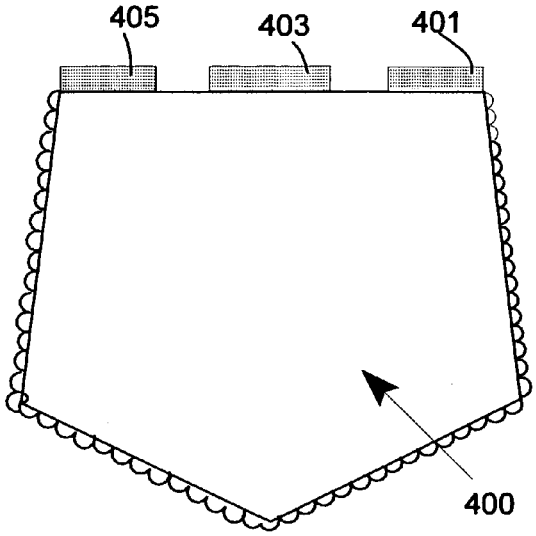
FIG. 26A is a view of the right side of an Adjustable-Width Jabot in its spread position with the fastener segments spaced across the top.
Figure 26C:
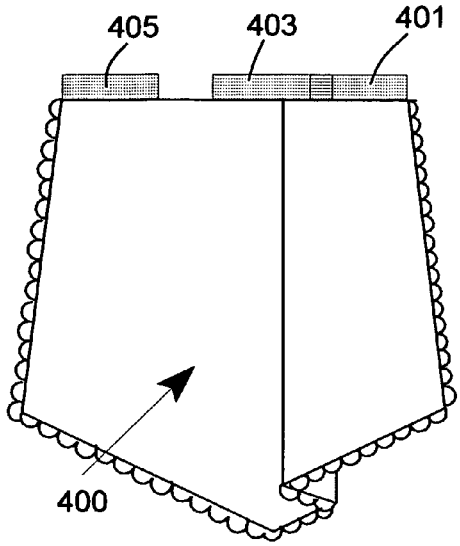
FIG. 26C is a view of the front of the Adjustable-Width Jabot showing the fastener segments and a fold formed on the right.
Figure 26B:
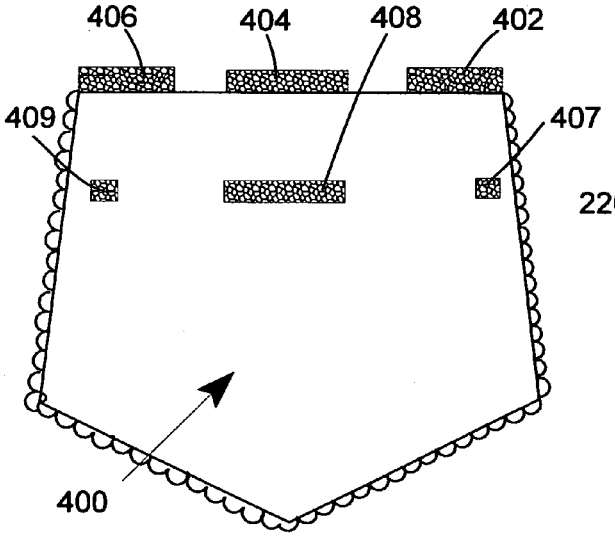
FIG. 26B is a view of the rear, lining side of the Adjustable-Width Jabot with two parallel rows of fastener segments, one of which is spaced across the top and the other, a few inches down from the top.
Figure 26D:
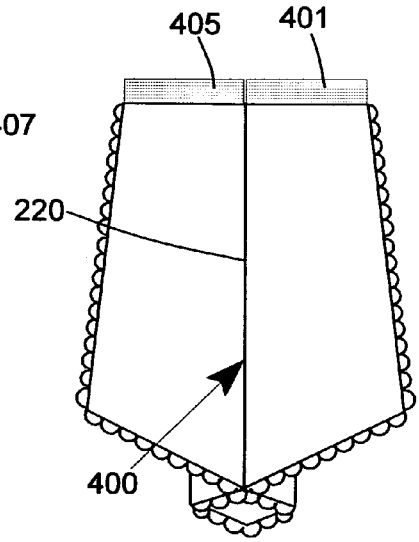
FIG. 26D is a view of the front of the Adjustable-Width Jabot in its folded, inverted pleat position showing the resulting fastener segments across the top.
Figure 26I:
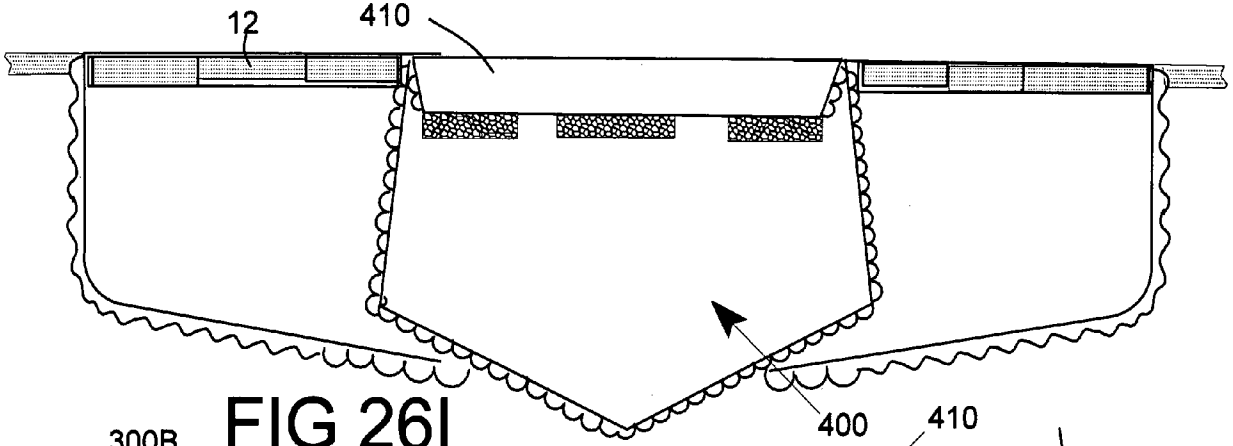
FIG. 26I is a rear view of a treatment showing the flap which results from the application of the Adjustable-Width Jabot via its lower line of fastener segments when applied to the fastener of the Adjustable-Width, Shaped-Hem Overlays and a Rod Sleeve.
Figure 26J:
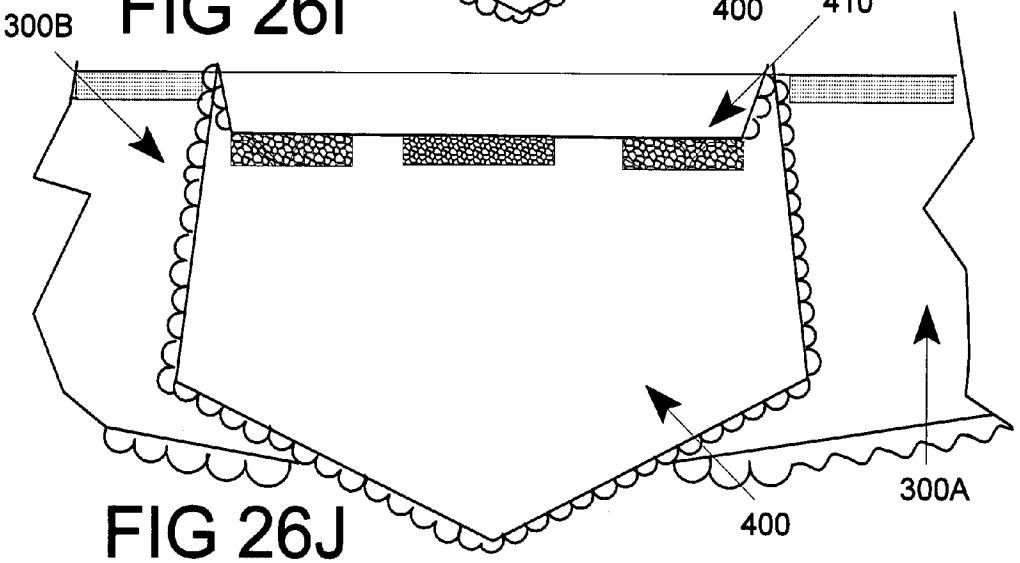
FIG. 26J is a close-up of the flap of FIG. 26I.
Figure 26H:
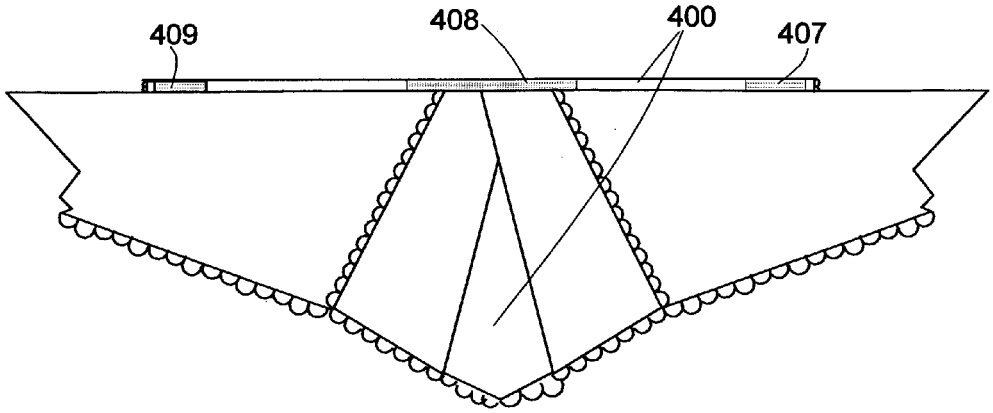
FIG. 26H is a rear view of FIG. 26A showing the resulting look when the lower level of fastener segments on the rear side of the Adjustable-Width Jabot have been applied to the fastener of the Rod Sleeve.
Figure 26K:
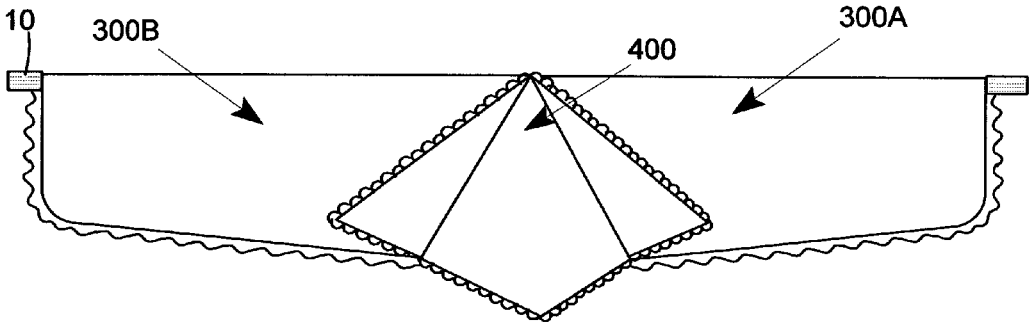
FIG. 26K is a view of the window treatment of FIG. 26H, also seen from above.

The tab (301, 302 of FIG. 25DE can also be used to hold the fold or "flap" 3011, 3022 of each piece to the front on an angle as shown in FIG. 26. A third valance piece, called a jabot 400, has been mounted underneath the overlays 300A, 300B at the center to fill up the empty space on the valance. A jabot 400 is a common decorative valance section. This one has been fitted with fastener segments across the top so it can also be folded (in the same manner as demonstrated in the Inverted Pleat/Box Pleat Overlays 200 above.) FIGS. 26A and 26B present the front and back views respectively of this particular style jabot 400 with hook segments (401, 403, 405) spaced across the top on the front and loop segments (402, 404, 406) spaced across the top on the back. In FIG. 26C a pleat has been formed on one half of the jabot 400. In FIG. 26D, another pleat has been formed completing an inverted pleat 220. In this form the jabot 400 is to be used as merely a decorative ornament (See FIG. 26E.) If desired for style and extra width, the jabot 400 may be left unfolded and used in yet another way as is demonstrated in FIG. 26F. As was seen in FIG. 26 the jabot (400) may be used as an underlay. To achieve the appropriate drop (vertical length/size) for this use, the jabot 400 has been equipped with extra segments (407, 408, 409) of loop fastener at a lower level from the top edge on the rear, the lining side of the jabot 400. See FIGS. 26B and 26G where the lower line of loop segments would be a white fabric loop fastener. FIG. 26G shows the rear view of the folded jabot 400 with the white fabric loop segments 407, 408, 409 forming a near-solid horizontal line 3033 which can hold the jabot 400 in place when the shorter version is desired. Equipped with these two rows of loop the jabot 400 may be placed in the folded or unfolded position and in the shorter or longer drop (size.) FIG. 26H gives an overhead view of the jabot 400 mounted as an underlay via the lower-placed loop segments 407, 408, 409. FIGS. 26H shows the front view and 26J the rear. On the rear view can be seen how the top portion 410 of the jabot 400 (that part above the line of the lower-placed loop fastener) falls over to the back, as a flap, hidden from view. FIGS. 26I and 26J also show this flap 410.

There are various configurations and spacings of tabs/fasteners which can be used for producing different looks and dimensions, but the method of lateral and slanted (see FIG. 26 where the tab attaches the folded ends of a pair of valance pieces at an angle) and vertical movement even, for adjustability of width and design is practically the same.

For the flexibility of a vertical adjustment, the valance section can be styled and constructed to hang from the support device with an apex or apexes hanging from above the rod/rod sleeve. It will not have any fastener applied to the top edge in the area that is to be off the rod/rod sleeve. The elimination of a running strip of hook/loop fastener in the apex area(s) of this Vertically Adjustable Valance piece (1) removes the possibility of the strip showing when a part of the valance is lifted up vertically off the rod/rod sleeve and (2) allows the top to be less rigid so the fabric drapes more easily from the apex/apexes. Those remaining areas that need to be held up by the rod/rod sleeve need to be equipped with tab(s) or segment(s) so they may be attached along the support device (or, possibly, another valance segment) as the fit or style mandates. The appropriate placing of such tabs/segments allows for a secure connection of the remainder of the valance segment to the Rod Sleeve/other valance component(s.)

Figure 27A:
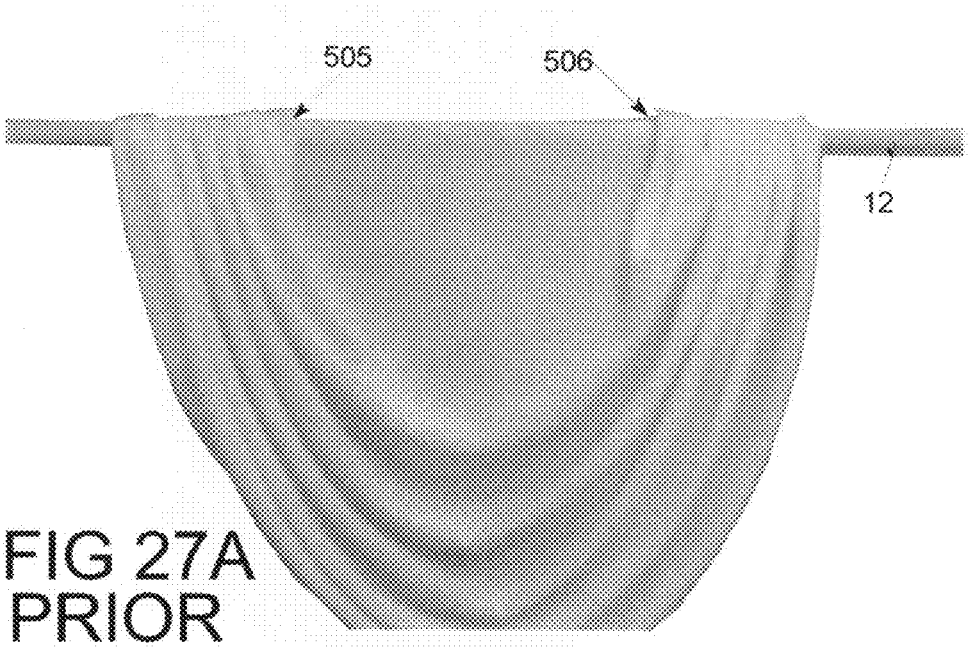
FIG. 27A is a view of the problem areas of the original Adjustable-Width Gathered Swag in its narrowest width.
Figure 27B:
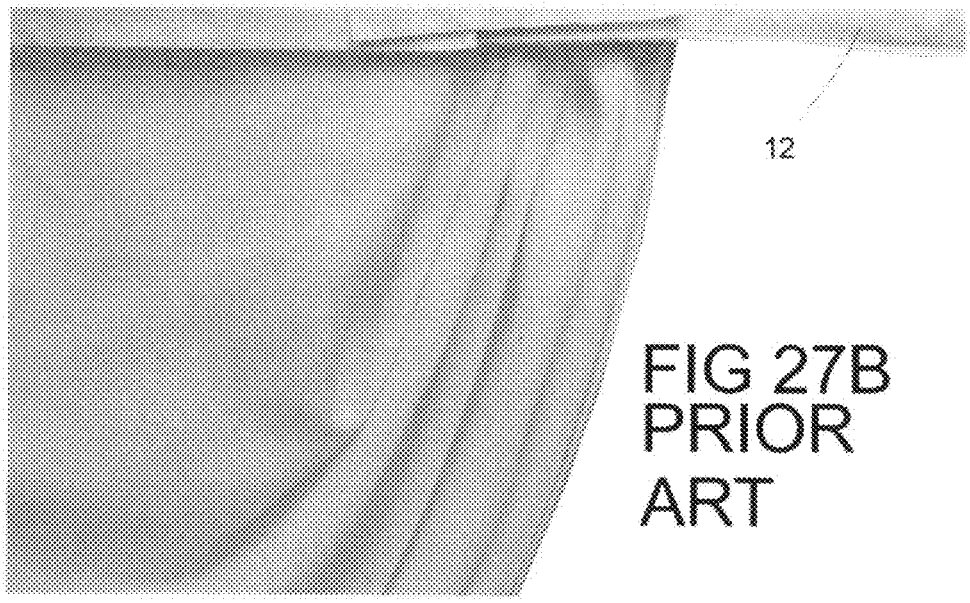
FIG. 27B is a rear view of FIG. 27A.
Figure 27C:
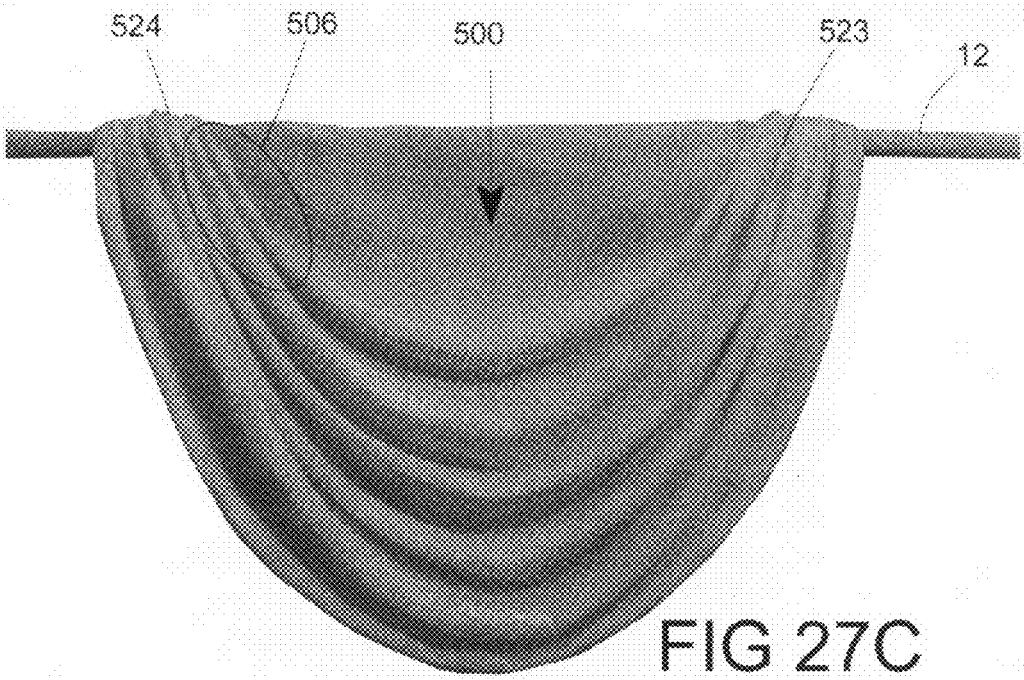
FIG. 27C is a front view of the revised Adjustable-Width Gathered Swag in which the problem areas of the prior art adjustable swag have been eliminated.
Figure 27D:
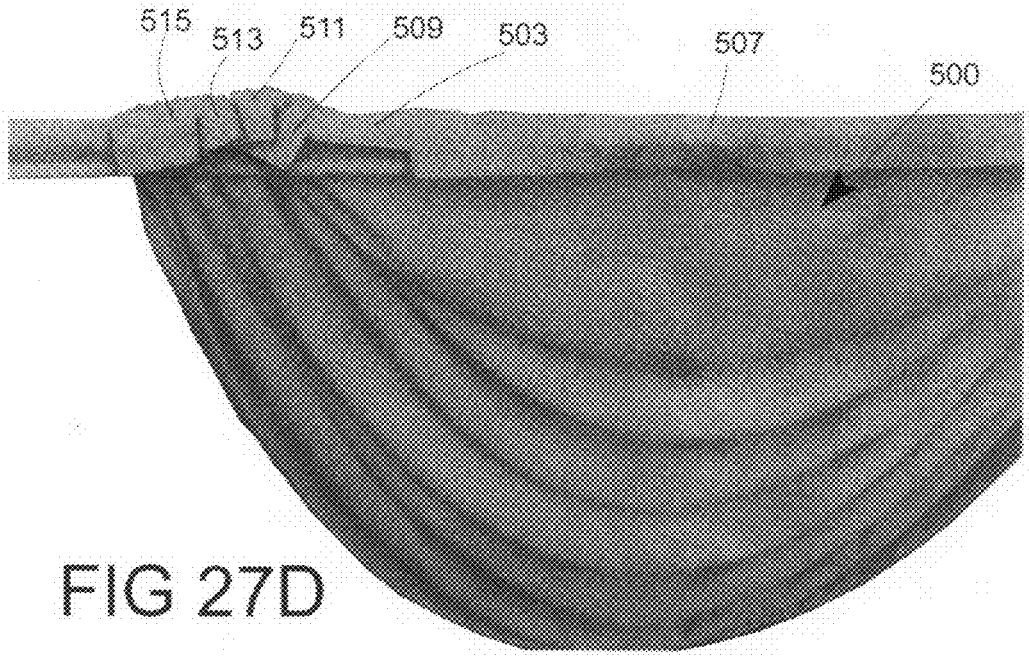
FIG. 27D is a rear view of the revised Adjustable-Width Gathered Swag of FIG. 27C showing the segmented fasteners.
Figure 27E:
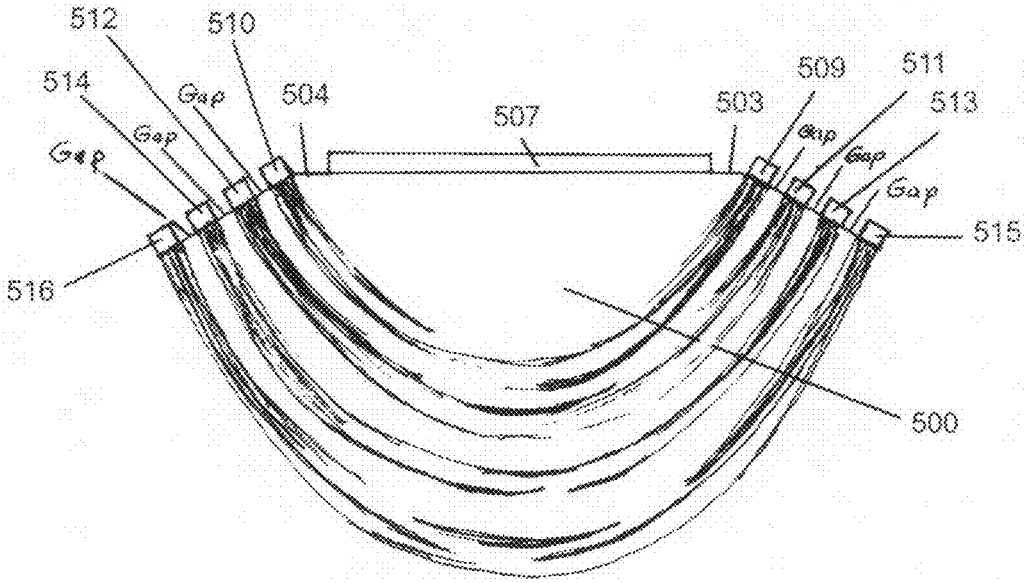
FIG. 27E is a front view of the swag of FIG. 27C prior to bringing the side fasteners to an upper position in which they may be attached to the central fastener segment or to a rod sleeve.
Figure 27F:
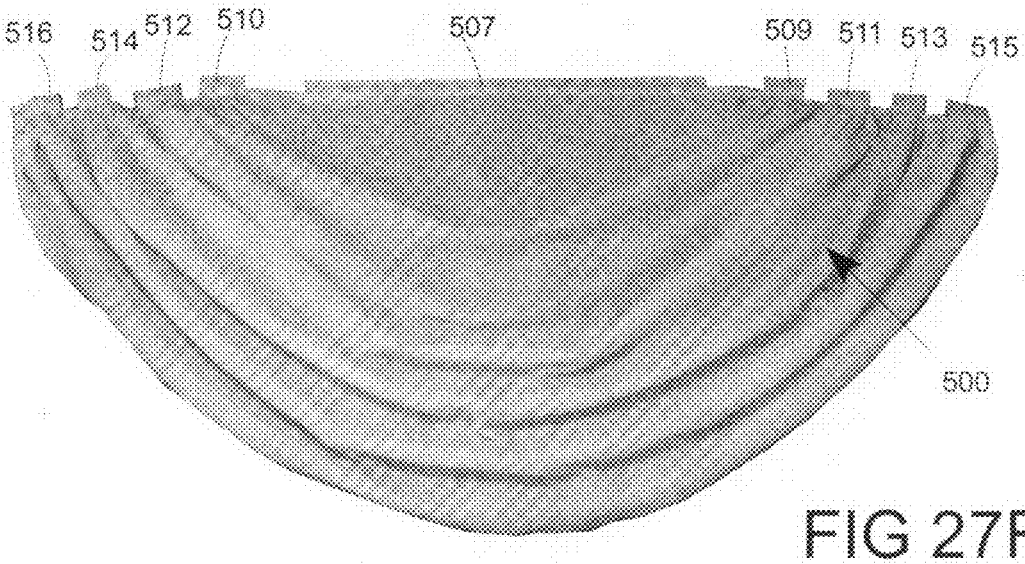
FIG. 27F is a front view of the swag of FIG. 27E after the sides have been raised to a fully extended position.

An example of another such use of and hook and loop faster tabs is the Gathered Adjustable-Width Swag of U.S. Pat. No. 6,732,783. FIG. 27A shows this prior art swag. FIG. 27A shows the problem of the look with the swag at its narrowest width of 28 inches (in this embodiment) when it has only one adjusting segment 501 at each end as in FIG. 27B. The graceful flow of the crescent-shaped folds is broken, bulging, and very unprofessional looking at the top of the gathered areas on each side of center. See 505 and 506 of FIGS. 27A and 27B which point to these incorrect looks. FIG. 27B gives the rear view of 27A showing the prior art with a one piece fastener segment overlapping the fastener strip 507 per the original method of narrowing the width. This method of adjustment to the width was accomplished by the lateral movement of each end segment toward the center of the swag, eliminating as much of the gaps 503 and 504 as desired, even overlapping segment 507 (each of which is present on both the prior art configuration and this embodiment as shown in FIG. 27E), in order to decrease the width of the swag. The faulty bunching bulging and broken curve of the prior art swag increased as the swag needed to be narrowed since there was only one adjusting segment per side. This malformed, unprofessional look can be corrected entirely by segmenting each end strip 501 of the fastener into two or more pieces or segments. FIGS. 27C-27F respectively show the front and the rear of a revised Adjustable-Width Gathered Swag with each end segment divided into four fastener segments 509, 511, 513, 515 on the right and 510, 512, 514, 516 on the left with gaps in between. The crescent-shaped folds correctly flow to the point of attachment at the top of the Adjustable-Width Gathered Swag 500 in its corrected state. The different placement of the four fastener segments which produce the more fluid look are shown in FIG. 27D. Note the gap (503) is fully spread between segments 509 and center segment 507 but all four segments overlap one another in order to achieve a 28" width. This gap 503 needs to be kept fully spread in all applied widths so that the first set of gathers held by the gap's adjacent fastener segment 509 can be kept taut. The tautness on the gathers determines or makes/breaks the flow of the folds. Of course, the same is true for the corresponding gap 504 on the opposite side and its adjacent fastener segment 510. The more fastener segments spaced over the gathered area and the wider the gaps between them, the more width adjustment available since it is the size of the gaps which allows the segments to be adjacently spaced/set at an angle/overlapped/spread apart as much as each gap allows. The manipulation of the position of each segment allows the customer to obtain a custom fit and keep the correct flow of the crescent folds in the swag's entire range of width. The widening of the Adjustable-Width Gathered Swag 500 does affect its drop (vertical length) however. This has to be kept in mind when applying this type swag in different widths on the same window or in the same room. This difference in drop between swags can be done to achieve a desired look, but one usually wants the drop/look to be the same all around the room. It should be noted that the first gap with its set of gathers may be incorporated into the top center segment 507 at the factory, but this construction method may not be labor efficient for mass production. If this construction procedure is adapted, however, it does not alleviate the need for segmenting the remaining gathers with gaps so an adjustability of width and proper look can be achieved by the consumer.

Figure 28:
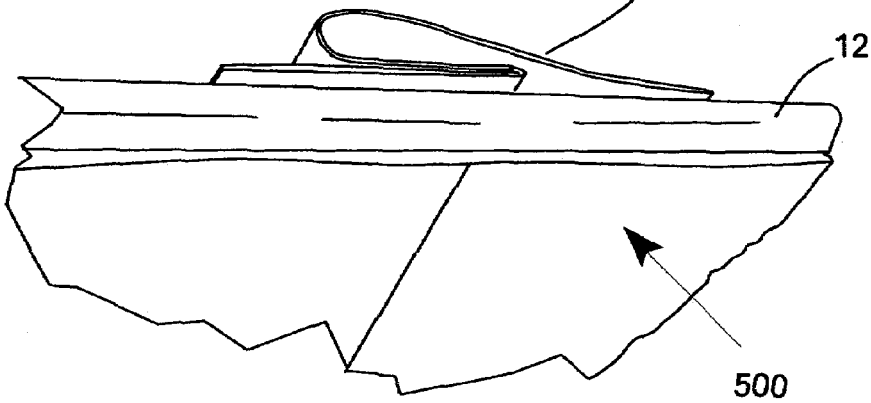
FIGS. 28 and 28A are views showing the advantages of segmented fastener strips.

These tabs and segments of hook and loop fasteners are absolutely necessary because the overlays with the continuous strip of fasteners would not be bendable (to the point of lying flat) as is clearly seen in FIG. 28. The breaks in the fastener strip along the top allow for easy folding of the fabric in the gaps between the fastener segments in any valance piece. See 206 and 208 of FIGS. 6 and 7 for an example of these gaps.

Figure 28A:
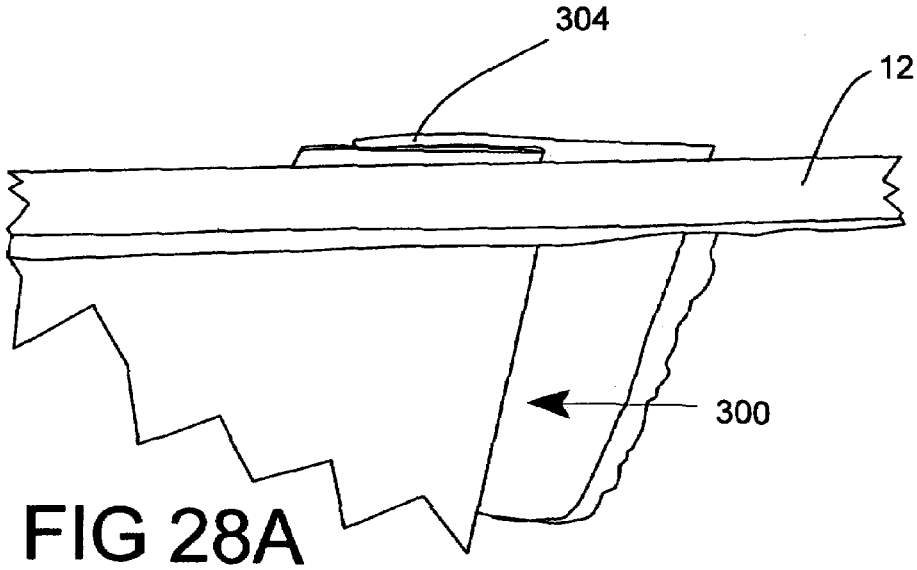

Subsequently, a professionally-made look can be achieved by the customer when the design or width of any piece is changed via the built-in gaps and fasteners. Refer to FIG. 28A. Achieving this flat, correct look via folding of the valance piece is not possible without breaks in the fastener strip. The hook and loop fastener which is available that is of sufficient strength for a secure attachment is too stiff and bulky to fold over itself, and it will not (in the loop or hook version) adhere to itself.

It should be noted that when compared to a continuous fastener strip across the top of a valance piece, the fastener segments and fastener tabs are sufficient to suspend the flat/the heavier gathered areas. The flat areas suspended by the segments or tabs will remain flat but they will perhaps not keep the valance pieces quite as taut on the Rod Sleeve since a continuous strip of hook and loop fastener does have more rigidity to it which stiffness, in conjunction with the stiffness of the Rod Sleeve, keeps the pieces taut. When mounted on a board, any flat piece properly applied will remain taut/flat (i.e., no wrinkles, no bunching) and that same look can be achieved even with the use of hook/loop fastener tabs and hook/loop fastener segments by making sure the Rod Sleeve is a bit longer (by ½" or so) than the rod, crowding it onto the rod so it abuts the wall tightly on both ends and therefore cannot "shrink" at all from the pull of the segments. This is one reason a telescoping curtain rod with hook and loop fasteners would be a better support device, but it would most likely be considerably more expensive that the ordinary curtain rod and a Rod Sleeve.

Completed Window Treatment

Figure 4:
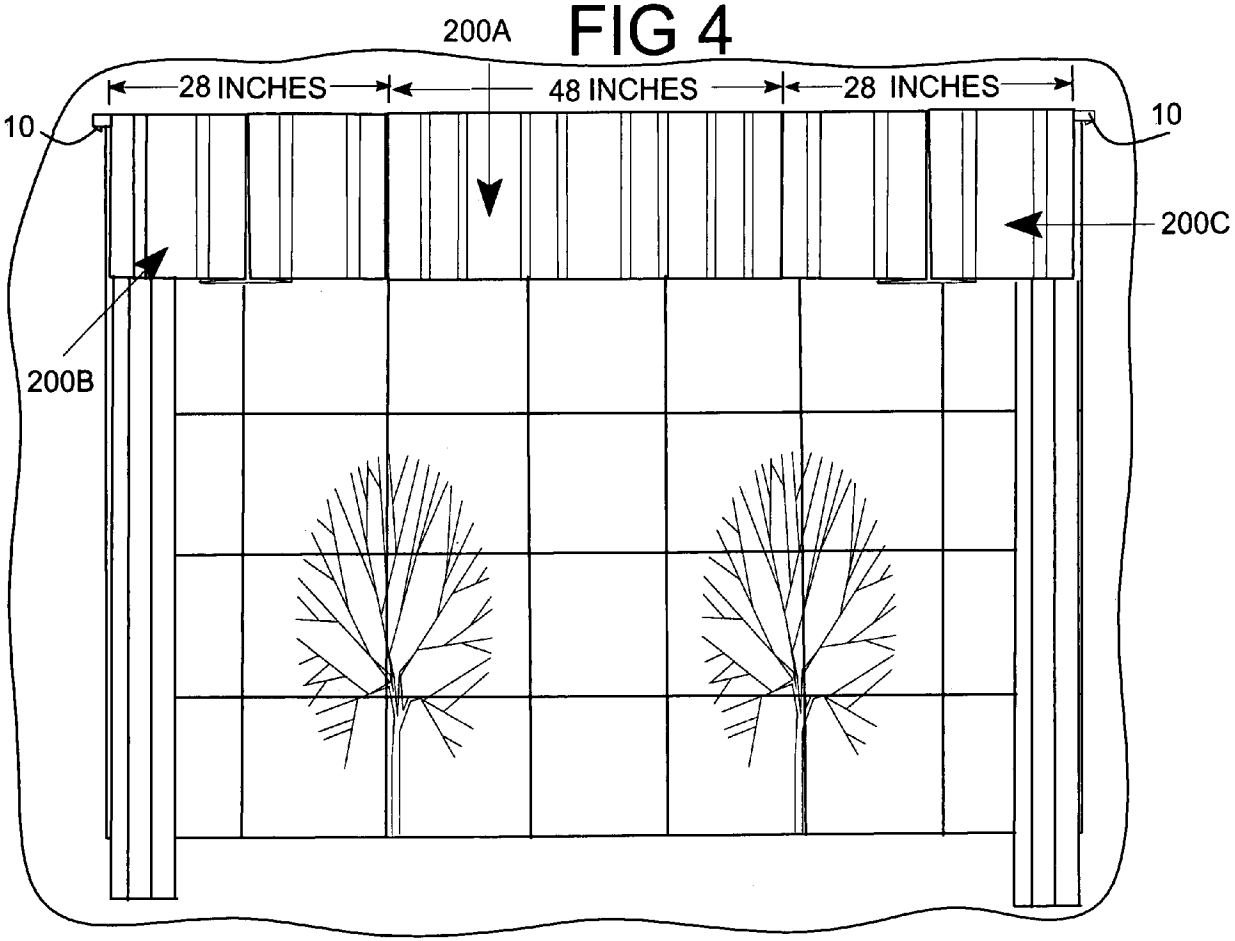
FIG. 4 is a view of a window treatment formed by a series of overlays positioned side by side over a window, showing the manner in which the width of the valances can be adjusted to fit a specific window.
Figure 29:
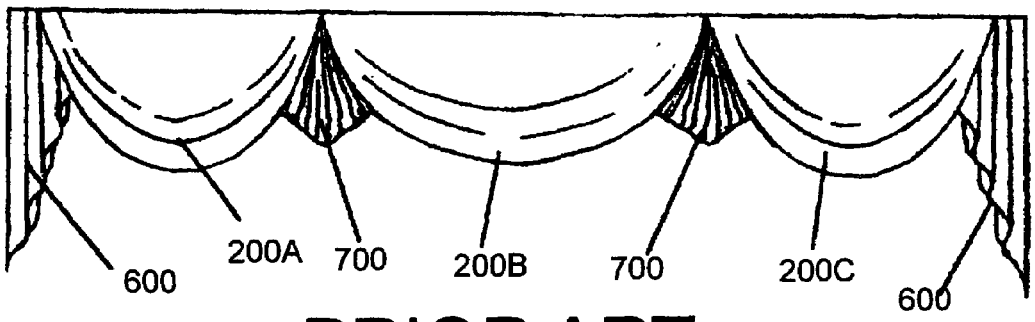
PRIOR ART FIG 29
FIG. 29 is a view of a window treatment assembly including multiple adjustable fabric valance components, including swags, mounted on a standard curtain rod.

FIG. 4 is a representative view of a completed window treatment including several standard components. In this example, three adjustable-width, pleated Swags 200A, 200B and 200C have been placed side by side over a single window. Each swag is hung from a curtain rod 2, shown in FIG. 1, over which a rod sleeve 10, shown in FIGS. 2-4, has been inserted. In order to fit the window in question, the middle swag has been expanded to its maximum width and it drop is at its minimum. The two outermost swags have been installed at their narrowest width, with a corresponding maximum drop. The differences in width and drop have been exaggerated in FIG. 4 for illustration purposes. In an actual installation, the maximum and minimum drops would differ by only approximately one inch and would not normally be noticeable. Of course, the three swags would probably be adjusted so that they would each span the same width, and would therefore have an equal drop. FIG. 29 is intended only to show the versatility of this approach. In addition to the swags 200, additional components have been added to this example. Cascades 600 have been added at each end. These cascades can be attached to the portion of the rod sleeve 10 extending around the curtain rod return 4. See FIGS. 1-4. A loop fastener would be attached to the top of the cascade, and it would function in the same manner as the primary loop strip on adjustable swag. This cascade loop fastener could be attached either to the rod sleeve hook strip 12 or to the hook fastener strip on the adjacent swag, or to both hook fastener strips. Decorative jabots 700 are shown attached between adjacent swags 200A, 200B and 200C covering the intersection of these fabric window treatment components. These jabots are draped over the curtain rod in the same fashion as the swags. Loop fastener strips would be located at the top of the jabots to attach to the hook fastener strips between the curtain rod 2 and the wall above the window. Other decorative accessories, such as rosettes, could be used in a similar manner.

The embodiment depicted herein are representative of adjustable window treatments that can be hung from a conventional curtain rod or other rod, but will have the same appearance as custom made window treatment fabrics nailed to a board. The examples depicted herein are only representative in nature. Other decorative configurations can employ the invention as disclosed herein and these other configurations can be used alone or in combination with the adjustable window treatment fabrics described herein.

I claim:

1. An adjustable width window treatment comprising:

an overlay having a top edge adapted to be suspended from a support device mounted above a window, the overlay providing a decorative covering for at least a portion of the window;

a plurality of fastener tabs extending upward along and from the top edge of the overlay, adjacent tabs being separated by gaps extending along the width of the top edge of the overlay, each fastener tab having a front and a rear surface with a first fastener means located on the front surface and a second fastener means located on the rear surface, the first fastener means being attachable to the second fastener means;

wherein the overlay is foldable at any lateral position within the gaps between adjacent fastener tabs so that the window treatment can be adjusted to fit windows having different widths, and wherein adjacent fastener tabs are spaced apart so that a second fastener means on the rear surface of a first tab can be attached, in overlying relationship, to a first fastener means on an adjacent second tab when the overlay is folded along a lateral position of a gap between the first and second tabs.

2. The adjustable width window treatment of claim 1 wherein the first and second fastener means comprise a combination of hook and loop fasteners.

3. The adjustable width window treatment of claim 2 wherein the first fastener means comprises a hook fastener and the second fastener means comprises a loop fastener.

4. The adjustable width window treatment of claim 1 wherein the first fabric fastener means are not attachable to the other first fastener means and the second fastener means are not attachable to the second fastener means.

5. The adjustable width window treatment of claim 1 wherein the overlay comprises a flat fabric foldable along straight lines extending transverse to the top edge.

6. The adjustable width window treatment of claim 1 wherein the overlay is cut so that when sections of the overlay are folded, curved folds are established.

7. The adjustable width window treatment of claim 1 further including end tabs located at opposite ends of the top edge of the overlay.

8. The adjustable width window treatment of claim 7 wherein the end tabs have identical fastener means on opposite surfaces thereof.

9. The adjustable width window treatment of claim 7 wherein the end tabs have loop fasteners on opposite surfaces thereof.

10. The adjustable width window treatment of claim 1 wherein overlays are attachable to adjacent overlays in overlapping relationship.

11. An adjustable width window treatment apparatus comprising:

a support device mountable above a window, the support device having a support fastener means extending continuously along a rear surface of the support device facing a wall above the window;

an overlay having a top edge adapted to be suspended from the support device when draped over the support device, the overlay providing a decorative covering for at least a portion of the window;

a plurality of fastener tabs extending upward along and from the top edge of the overlay, adjacent tabs being separated by gaps extending along the width of the top edge of the overlay, each fastener tab having a front and a rear surface with a first fastener means located on the front surface and a second fastener means located on the rear surface, the second fastener means being attachable to the support fastener means on the support member, the first fastener means being attachable to the second fastener means, wherein first fastener means are not attachable to other first fastener means and second fastener means are not attachable to second fastener means: and wherein the overlay is foldable between at any lateral position within the gaps between adjacent fastener tabs so that the window treatment can be adjusted to fit windows having different widths, and wherein adjacent fastener tabs are spaced apart so that a second fastener means on the rear surface of a first tab can be attached, in overlying relationship, to a first fastener means on an adjacent second tab when the overlay is folded along a lateral position of a gap between the first and second tabs.

12. The adjustable width window treatment apparatus of claim 11 wherein the support device comprises a rod.

13. The adjustable width window treatment apparatus of claim 12 wherein the support fastener means comprises a hook fastener.

14. The adjustable width window treatment apparatus of claim 13 wherein the support device comprises a sleeve insertable over a rod and the hook fastener is located on the sleeve.

15. The adjustable width window treatment apparatus of claim 11 wherein a plurality of overlays are mountable on the support device.

16. The adjustable width window treatment apparatus of claim 15 wherein adjacent overlays are mountable in overlapping relationship.

17. The adjustable width window treatment apparatus of claim 16 wherein adjacent tabs on at least one overlay are positioned in overlaying relationship with first fastener means attached to second fastener means.

18. The adjustable width window treatment apparatus of claim 11 wherein the overlay is attachable to a support device rear surface.

19. An overlay for use as a window valance, wherein the overlay comprises:

a fabric having an upper edge;

a plurality of separate tabs extending along and from the upper edge of the fabric, adjacent tabs being separated by gaps along the upper edge of the fabric;

first upper fasteners on a first surface of the tabs and second upper fasteners on an opposite second surface of the tabs, the first upper fasteners and the second upper fasteners having cooperating structures that attach to each other;

first lower fasteners located on the fabric below the first upper fasteners, the first lower fasteners being of the same structure as the first upper fasteners;

the fabric being foldable horizontally so that the a flap can be formed between the first upper fasteners and the first lower fasteners, so that either the first upper fasteners or the first lower fasteners can be attached to a support device to adjust the drop of the overlay, the second upper fasteners being exposed when the fabric is folded to form a flap so that other components can be attached to the overlay.

20. The overlay of claim 19 wherein the overlay comprises a jabot.

* * * * *